US009535364B2

(12) United States Patent
Shimizu

(10) Patent No.: US 9,535,364 B2
(45) Date of Patent: Jan. 3, 2017

(54) IMAGE FORMING APPARATUS

(71) Applicant: Oki Data Corporation, Tokyo (JP)

(72) Inventor: Takatoku Shimizu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/920,500

(22) Filed: Oct. 22, 2015

(65) Prior Publication Data

US 2016/0223942 A1 Aug. 4, 2016

(30) Foreign Application Priority Data

Jan. 30, 2015 (JP) ..... 2015-016724

(51) Int. Cl.
*G03G 15/06* (2006.01)
*G03G 15/08* (2006.01)
*G03G 15/00* (2006.01)

(52) U.S. Cl.
CPC ..... *G03G 15/0848* (2013.01); *G03G 15/5041* (2013.01); *G03G 15/5054* (2013.01); *G03G 15/5058* (2013.01); *G03G 2215/00029* (2013.01); *G03G 2215/00059* (2013.01); *G03G 2215/0129* (2013.01); *G03G 2215/0164* (2013.01)

(58) Field of Classification Search
CPC ..... G03G 15/0848; G03G 15/5041; G03G 15/5054; G03G 15/5058; G03G 2215/00029; G03G 2215/00059
See application file for complete search history.

(56) References Cited

U.S. PATENT DOCUMENTS

2004/0240899 A1* 12/2004 Ebe ..... G03G 15/5058 399/44
2008/0008486 A1* 1/2008 Saida ..... G03G 15/0173 399/49
2010/0266301 A1* 10/2010 Ohshika ..... G03G 15/5008 399/43

(Continued)

FOREIGN PATENT DOCUMENTS

JP 2004-29681 A 1/2004

*Primary Examiner* — Ryan Walsh
(74) *Attorney, Agent, or Firm* — Muncy, Geissler, Olds & Lowe, P.C.

(57) ABSTRACT

An image forming apparatus includes an exposure part forming an electrostatic latent image on a charge region, a developer carrier developing the electrostatic latent image into two types of development images (printing developer image and no-printing developer image), a supply member supplying developer to the developer carrier, a first detection part detecting a first physical quantity correlating to the density of the no-printing developer image, a setting part performing a setting, based on the first physical quantity, for a development voltage applied to the developer carrier or a supply voltage applied to the supply member, a second detection part detecting a second physical quantity correlating to a number of rotations after the print of the printing developer image starts, a correction part correcting, based on the second physical quantity, the development voltage or the supply voltage set by the setting part, and a power source part applying the development voltage to the developer carrier and applies the supply voltage to the supply member.

14 Claims, 12 Drawing Sheets

(56) References Cited

U.S. PATENT DOCUMENTS

| | | | | |
|---|---|---|---|---|
| 2012/0062684 | A1* | 3/2012 | Okuno | B41J 2/39<br>347/141 |
| 2015/0023675 | A1* | 1/2015 | Matsushita | G03G 15/50<br>399/38 |

* cited by examiner

*Fig. 5*

130

| Develop. Volt. $V_{34}$ at Start of Conti. Printing | Continuous Print Count Nc | | | | | |
|---|---|---|---|---|---|---|
| | 500 and More Less Than 1,000 | 1,000 and More Less Than 1,500 | 1,500 and More Less Than 2,000 | 2,000 and More Less Than 2,500 | 2,500 and More Less Than 3,000 | 3,000 and More |
| Less Than \|180\|V | +17 | +34 | +51 | +68 | +85 | +102 |
| \|180\|V and More Less Than \|230\|V | +12 | +24 | +36 | +48 | +60 | +72 |
| \|230\|V and More | +8 | +16 | +24 | +32 | +40 | +48 |

IMAGE FORMING APPARATUS

CROSS REFERENCE

The present application is related to, claims priority from and incorporates by reference Japanese Patent Application No. 2015-016724, filed on Jan. 30, 2015.

The present invention relates to an electrographic system image forming apparatus.

BACKGROUND

In an electrographic system image forming apparatus, after a photosensitive drum is charged negatively by a charge roller, an electrostatic latent image is formed when light is irradiated at the negatively charged portion of the photosensitive drum. The electrostatic latent image is developed by a developer supplied from a development roller and a supply roller, and a developer image produced by development is transferred onto a sheet by transfer rollers.

When the image forming apparatus is a printer forming color images, to faithfully reproduce a color image, there is a need to strictly control the amount of developer to be transferred onto a sheet. For example, Patent Document 1 discloses that the developer density of the patch pattern printed on a transfer belt is measured, and the processing conditions are controlled based on the density data obtained from the measurement.

RELATED ART

Japanese Unexamined Patent Application Publication No. 2004-29681

However, in the image forming apparatus described in Patent Document 1, since normal printing needs to be interrupted to measure the developer density of the patch pattern, the developer density of the patch pattern cannot be measured during printing. Therefore, in a case in which the continuous printing time is prolonged under a processing condition that is once set, the print image density may differ from the start of the printing to after printing was performed for a long time.

The present invention was made in view of the aforementioned problems and aims to provide an image forming apparatus capable of stabilizing the print image density during long printing.

SUMMARY

An image forming apparatus includes an image carrier that has a peripheral surface including a photosensitive body; a charge member that charges the peripheral surface; an exposure part that forms an electrostatic latent image on a charge region on the peripheral surface charged by the charge member; a developer carrier that develops the electrostatic latent image by a developer into two types of development images which are printing developer image and no-printing developer image, the printing developer image being to be printed on a medium, and the no-printing developer image being not to be printed but formed on the developer carrier before the printing developer image is printed to the medium; a supply member that supplies the developer to the developer carrier; a first detection part that detects a first physical quantity correlating to the density of the no-printing developer image; a setting part that performs a setting, based on the first physical quantity detected by the first detection part, for at least one of a development voltage to be applied to the developer carrier and a supply voltage to be applied to the supply member; a second detection part that detects a second physical quantity correlating to a number of rotations after the print of the printing developer image starts; a correction part that corrects, based on the second physical quantity detected by the second detection part, at least one of the development voltage and the supply voltage set by the setting part; and a power source part that applies the development voltage to the developer carrier and applies the supply voltage to the supply member.

According to an image forming apparatus as one embodiment of the present invention, the print image density can be stabilized for long printing.

BRIEF DESCRIPTION OF THE DRAWINGS

FIG. 5 is a diagram showing one example of a correction table.

DETAILED DESCRIPTION OF THE EMBODIMENTS

Hereinafter, embodiments of the present invention will be explained in detail with reference to the drawings. The following explanation is one example of the present invention and the present invention is not limited to the following embodiments. Also, for the present invention, the arrangement, the dimensions, and the proportions of each structural component shown in each drawing are not limited to those. Further, the explanation will be done in the following order.

1. Embodiment

An example in which the development voltage set before the start of printing is corrected based on the continuous print count 2. Modified Example Modified Example 1: an example in which the supply voltage is corrected Modified Example 2: an example in which the development voltage and the supply voltage are corrected Modified Example 3: an example in which the interval for executing the voltage correction differs according to the setting value Modified Example 4: an example in which the correction value is constant regardless of the setting value Modified Example 5: various modified examples

1. Embodiment

Configuration

Figure 1:
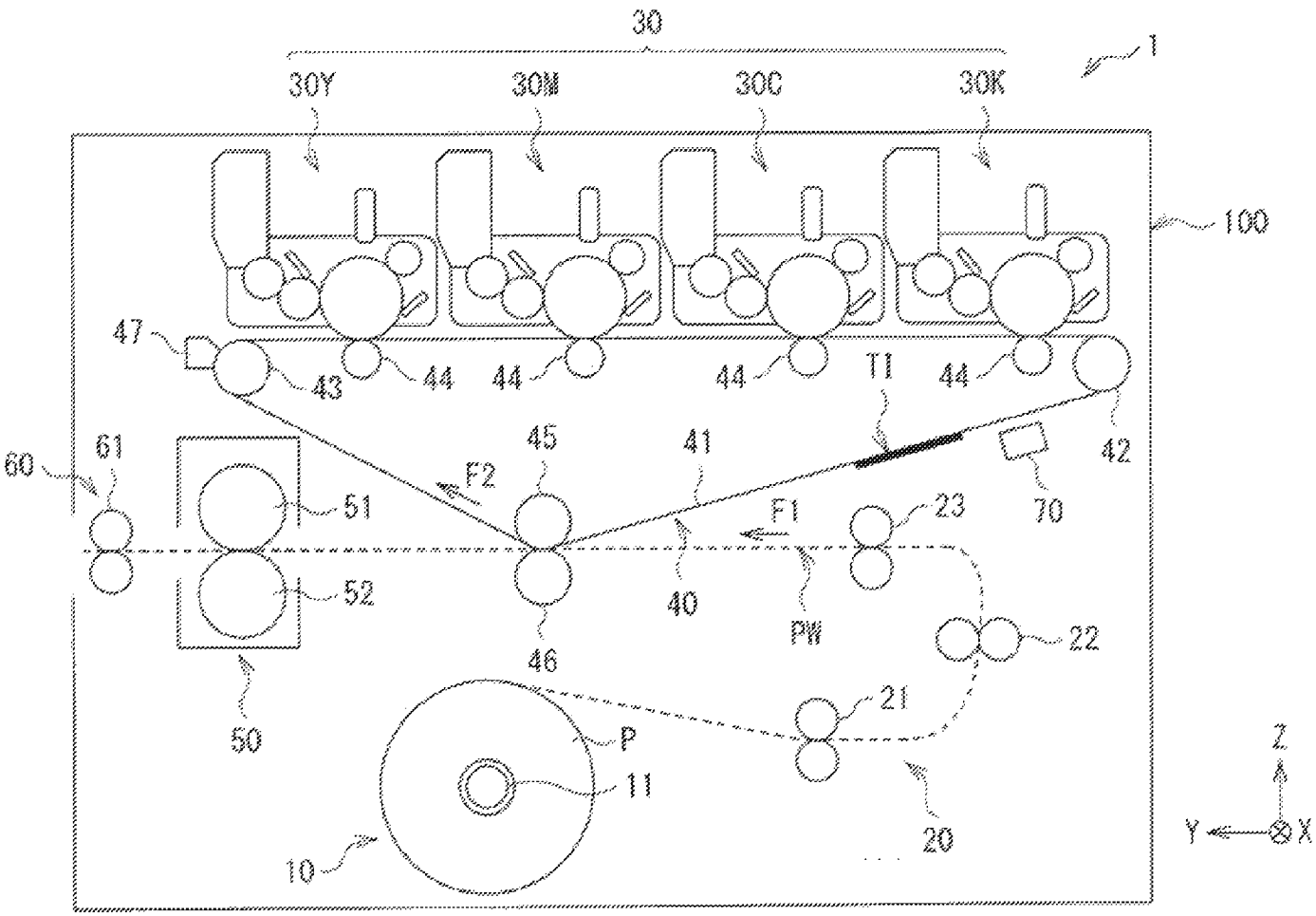
FIG. 1 is a schematic view showing an example of a schematic configuration of an image forming apparatus according to an embodiment of the present invention.

FIG. 1 schematically shows a schematic configuration example of an image forming apparatus 1 according to an embodiment of the present invention. The image forming apparatus 1 is a printer which forms color images on a medium P using an electrographic system. The medium P is, for example, a long label paper in which a plurality of labels are pasted at predetermined intervals on one side of a long mount and constituted as a roll paper wound into a rolled state. The medium P corresponds to one specific example of a "medium" of the present invention. The image forming apparatus 1 is equipped with a medium container part 10, a sheet feeding and carrying part 20, an image forming part 30, a transfer part 40, a fuser part 50, an ejection part 60, and a concentration sensor 70. The medium container part 10, the sheet feeding and carrying part 20, the image forming part 30, the transfer part 40, the fuser part 50, the ejection part 60, and the concentration sensor 70 are provided inside a housing 100. The concentration sensor 70 corresponds to one specific example of "the first detection part" of the present invention.

In this specification, a path along which the medium P is carried is referred to as a carrying path PW. In the carrying path PW, a direction toward the medium container part 10 or a position closer to the medium container part 10 as viewed from an arbitrary component is referred to as "upstream of the carrying path PW". In the carrying path PW, a direction opposite to the direction toward the medium container part 10 or a position farther from the medium container part 10 as viewed from an arbitrary component is referred to as "downstream of the carrying path PW". In the carrying path PW, the direction along which the medium P advances (that is, a direction from the upstream of the carrying path PW toward the downstream of the carrying path PW) is referred to as a carrying direction F1.

(Configuration of Medium Container Part 10)

The medium container part 10 accommodates the medium P. The medium container part 10, for example, is provided with a holding shaft 11 for rotatably holding the medium P.

(Configuration of Sheet Feeding and Carrying Part 20)

The sheet feeding and carrying part 20 feeds out the medium P from the medium container part 10 and regulates the skew, and further carries it to the transfer part 40 along the carrying path PW. The sheet feeding and carrying part 20 is arranged more downstream of the carrying path PW than the medium container part 10. The sheet feeding and carrying part 20 is provided with, for example, a feeding roller pair 21, a carrying roller pair 22, and a registration roller pair 23. The feeding roller pair 21, the carrying roller pair 22, and the registration roller pair 23 are arranged in the order of the feeding roller pair 21, the carrying roller pair 22, and the registration roller pair 23 toward the carrying direction F1.

The feeding roller pair 21 is for supplying the medium P to the carrying path PW. The feeding roller pair 21 rotates in the direction in which the medium P is fed to the carrying path PW by being controlled by a later explained control part 101. The carrying roller pair 22 carries the medium P in the carrying direction F1 along the carrying path PW. The carrying roller pair 22 rotates in the direction in which the medium P is carried in the carrying direction F1 by being controlled by the later explained control part 101. The registration roller pair 23 regulates the skewing of the medium P. The registration roller pair 23 rotates in the direction in which the medium P is carried in the carrying direction F1 by being controlled by the later explained control part 101 and regulates the skew of the medium P.

(Configuration of Image Forming Part 30)

The image forming part 30 forms images on the peripheral surface 31A of a later explained photosensitive drum 31. The image forming part 30, for example, is provided with four image forming units. The four image forming units are constituted by, for example, as shown in FIG. 1, image forming units 30Y, 30M, 30C, and 30K. The image forming units 30Y, 30M, 30C, and 30K form toner images (images) of each color using each of the corresponding toners, that is, yellow toner, magenta toner, cyan toner, and black toner. The image forming units 30Y, 30M, 30C, and 30K are arranged in the order of, for example, the image forming unit 30Y, the image forming unit 30M, image forming unit 30C, the image forming unit 30K toward the rotational direction F2 of a later explained transfer belt 41. The image forming units 30Y, 30M, 30C, and 30K are constituted by common elements. Hereinafter, the image forming unit 30Y will be explained as a representative for the image forming units 30Y, 30M, 30C, and 30K.

Figure 2:
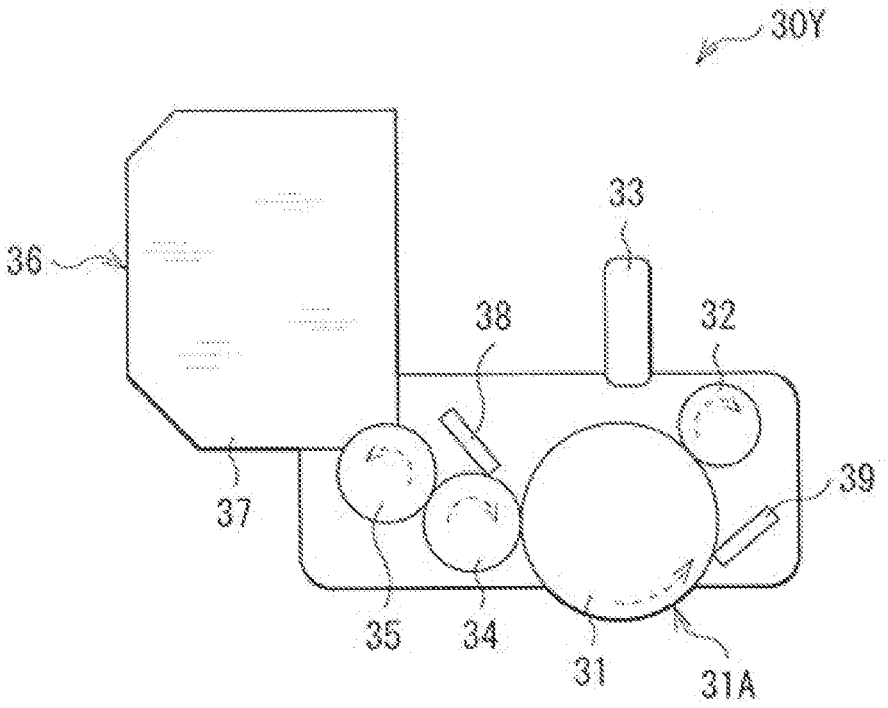
FIG. 2 is a schematic view showing an example of a schematic configuration of an image forming unit of FIG. 1.

FIG. 2 schematically shows an example of a schematic configuration of the image forming unit 30Y. The image forming unit 30Y is equipped with, for example, a photosensitive drum 31, a charge roller 32, a LED (Light Emitting Diode) head 33, a development roller 34, a supply roller 35, a cartridge 36, a regulating blade 38, and a cleaning blade 39. The cartridge 36 is filled with a toner 37. The photosensitive drum 31 corresponds to one specific example of the "image carrier" of the present invention. The charge roller 32 corresponds to one specific example the "charge member" of the present invention. The LED head 33 corresponds to one specific example of the "exposure portion" of the present invention. The development roller 34 corresponds to one specific example of the "developer carrier" of the present invention. The supply roller 35 corresponds to one specific example of the "supply member" of the present invention. The toner 37 corresponds to one specific example of the "developer" of the present invention. The shape of the aforementioned image carrier is not limited to a drum, and can be a belt. The shape of the aforementioned charge member and the supply member is not limited to a roller. It can be implemented as a belt.

The photosensitive drum 31 is provided with a peripheral surface including a photosensitive body (e.g., organic photosensitive body) and it is a column-shaped member capable of supporting an electrostatic latent image on the peripheral surface 31A. Specifically, the photosensitive drum 31 is provided with a conductive supporting body and a photoconductive layer covering its outer periphery (surface). The conductive supporting body is constituted by, e.g., a metal pipe made of an aluminum. The photoconductive layer has a structure in which, for example, a charge generation layer and a charge transportation layer are laminated in that order. The photosensitive drum 31 is configured to rotate in the direction in which the transfer belt 41 rotates in the carrying direction F2 at a predetermined peripheral speed by being controlled by the control part 101.

The charge roller 32 is a member (charger member) for charging the peripheral surface 31A of the photosensitive drum 31. The charge roller 32 is arranged so as to be in contact with the peripheral surface 31A of the photosensitive drum 31 and arranged facing the peripheral surface 31A. The charge roller 32 is provided with, for example, a metal shaft made of stainless steel and a semiconductive elastic layer (e.g., a semiconductive epichlorohydrin layer) covering its outer periphery (surface). The charge roller 32, for example, is configured to rotate in a direction opposite to a rotational direction of the photosensitive drum 31 due to the drive transmission of the photosensitive drum 31.

The LED head 33 is an exposure device for forming electrostatic latent images in the charge region of the peripheral surface 31A by exposing the charge region of the peripheral surface 31A charged by the charge roller 32. The LED head 33 is arranged so as to face the peripheral surface 31A at a downstream position in the rotating direction of the photosensitive drum 31 than the charge roller 32. The LED head 33 is provided with a plurality of LED light emitting parts aligned in the widthwise direction of the photosensitive drum 31. Each LED light emitting part is constituted so as to include, for example, a light source such as a light emitting diode emitting irradiation light and a lens array for forming images on the surface of the photosensitive drum 31 using the irradiation light.

The development roller 34 is a member for carrying the toner 37 to the surface and develops an electrostatic latent image using the toner 37. The development roller 34 is arranged so as to be in contact with the peripheral surface 31A of the photosensitive drum 31 and arranged facing the peripheral surface 31A at a downstream position in the rotational direction of the photosensitive drum 31 than the LED head 33. The development roller 34 is provided with, for example, a metal shaft made of stainless steel and a semiconductive elastic layer (e.g., a semiconductive urethane rubber layer) covering its outer periphery (surface). The development roller 34, for example, is configured to rotate in a direction opposite to the rotational direction of the photosensitive drum 31 due to the drive transmission of the photosensitive drum 31.

The supply roller 35 is a member (supply member) for supplying the toner 37 to the development roller 34, and it is arranged so as to be in contact with the surface (peripheral surface) of the development roller 34. The supply roller 35 is provided with, for example, a metal shaft made of stainless steel and a foaming elastic layer (i.e., a silicone rubber layer) covering its outer periphery (surface). The supply roller 35, for example, is configured to rotate in a direction opposite to the rotational direction of the development roller 34 due to the drive transmission of the development roller 34.

The cartridge 36 is a container in which the aforementioned toners 37 of each color are accommodated. In the image forming unit 30Y, a yellow toner 37 is accommodated in the cartridge 36. Similarly, a magenta toner 37 is accommodated in the cartridge 36 of the image forming unit 30M, a cyan toner 37 is accommodated in the cartridge 36 of the image forming unit 30C, and a black toner 37 is accommodated in the cartridge 36 of the image forming unit 30K. The toner 37 is, for example, a non-magnetic single-component developer.

The regulating blade 38 is for regulating the thickness of the toner 37 layer carried on the surface of the development roller 34. The regulating blade 38 is made of, for example, a thin plate of SUS (Steel Use Stainless). The cleaning blade 39 is for scraping off the toner 37 that remains on the surface of the photosensitive drum 31. The cleaning blade 39 is made of, for example, a flexible rubber material or a plastic material.

(Configuration of Transfer Part 40)

The transfer part 40 electrostatically transfers the image (toner image TI) formed on the peripheral surface 31A of the photosensitive drum 31 on the medium P carried from the sheet feeding and carrying part 20. The transfer part 40 is equipped with, for example, a transfer belt 41, a drive roller 42 for driving the transfer belt 41, a tension roller 43 which is a driven roller, a plurality of primary transfer rollers 44, an opposing roller 45, a secondary transfer roller 46, and a cleaning member 47. The transfer part 40 is a mechanism in which, after the toner images TI formed in each of the image forming units 30Y, 30M, 30C, and 30K are sequentially transferred to the surface of the transfer belt 41, the toner image TI on the transfer belt 41 is transferred to the medium P carried from the sheet feeding and carrying part 20.

The transfer belt 41 is, for example, an endless elastic belt made using a resin material such as a polyimide resin. The transfer belt 41 is extended (stretched) by the drive roller 42, the tension roller 43, and the opposing roller 45 and is supported rotatably. The drive roller 42 rotates the transfer belt 41 circularly in the rotational direction F2 while being controlled by the control part 101. The tension roller 43 adjusts the tension applied to the transfer belt 41 by the bias force from the bias member. The tension roller 43 rotates in the same direction as the drive roller 42.

A plurality of primary transfer rollers 44 are assigned one by one to each of the image forming units 30Y, 30M, 30C, and 30K. Each of the primary transfer rollers 44 electrostatically transfers the image formed on the peripheral surface 31A of the photosensitive drum 31 to the transfer belt 41. Each of the primary transfer rollers 44 is arranged so as to be in contact with the inner peripheral surface of the transfer belt 41 and facing the photosensitive drum 31. Each of the primary transfer rollers 44 is a member in which, for example, a metal shaft is covered with a conductive elastic body.

Each of the primary transfer rollers 44 is rotatably driven in a direction in which the transfer belt 41 travels in the transfer direction F2 by being controlled by the control part 101.

The opposing roller 45 and the secondary transfer roller 46 are arranged so as to face each other and sandwich the transfer belt 41. The secondary transfer roller 46 electrostatically transfers the toner image TI on the transfer belt 41 to the medium P carried along the carrying path PW. The secondary transfer roller 46 is equipped with, for example, a metallic core material and an elastic layer such as a foaming rubber layer formed so as to be wound on the outer peripheral surface of the core material. The opposing roller 45 and the secondary transfer roller 46 are rotatably driven in a direction in which the transfer belt 41 travels in the transfer direction F2 by being controlled by the control part 101. The cleaning member 47, for example, is arranged more downstream than the secondary transfer roller 46 and more upstream than the most upstream image forming unit (image forming unit 30Y) in the rotational direction F2 of the transfer belt 41. The cleaning member 47 is for scraping off the toner 37 that remains on the surface of the transfer belt 41. The cleaning member 47 is made of, for example, a flexible rubber material or plastic material.

(Configuration of Fuser Part 50)

The fuser part 50 is a member for fusing the toner image TI on the medium P by applying heat and pressure to a toner image TI transferred on the medium P which has passed through the transfer part 40. The fuser part 50 is arranged more downstream on the carrying path PW than the transfer part 40. The fuser part 50 is constituted so as to include, for example, an upper roller 51 and a lower roller 52.

The upper roller 51 and the lower roller 52 are each constituted so as to include a heat source which is a heater such as a halogen lamp, etc., inside and function as heating rollers for applying heat to the toner image TI on the medium P. The upper roller 51 rotates in the direction in which the medium P is carried in the carrying direction F1 by being controlled by a later explained control part 101. The heat source of the upper roller 51 and the lower roller 52 receives the supply of a bias voltage controlled by the control part 101 and controls the surface temperatures of the upper roller 51 and the lower roller 52. The lower roller 52 is arranged so as to face the upper roller 51 in a manner such that a press-contacted part is formed between the lower roller 52 and the upper roller 51, and functions as a pressure application roller for applying a pressure to the toner image TI on the medium P. The lower roller 52 is preferably provided with a surface layer made of an elastic body material.

(Configuration of Ejection Part 60)

The ejection part 60 ejects the medium P on which a toner image TI is fused by the fuser part 50 to the outside. The ejection part 60 is arranged more downstream on the carrying path PW than the fuser part 50. The ejection part 60 is provided with, for example, a carrying roller pair 61. The carrying roller pair 61 ejects the medium P to the outside via the carrying path PW, and for example, stocks them on an external stacker. The carrying roller pair 61 is configured to rotate in the direction in which the medium P is carried in the carrying direction F1 by being controlled by a later explained control part 101.

(Configuration of Concentration Sensor 70)

The concentration sensor 70 performs the detection of the density of the toner image TI on the transfer belt 41 that is not for printing (i.e., image density $D_I$) or the physical quantity correlating to the density. The density of the toner image TI that is not for printing corresponds to one specific example of "the density of the developer image that is not for printing" of the present invention. The physical quantity correlating to the density of the toner image TI that is not for printing is defined as "the first physical quantity" of the present invention. The density of the toner image IT itself is included in the first physical quantity. "Not for printing" means that printing is not performed on the medium P. The concentration sensor 70 performs the detection of the density of the toner image TI on the transfer belt 41 that is not for printing or the physical amount correlating to the density, before starting the printing by being controlled by the control part 101. "The start of printing" refers to the time at which the printing of a toner image TI for printing, formed by being developed by a development roller 34, onto the medium P is started. "For printing" means that printing is performed on the medium P. The above toner image (or developer image) that is formed not for printing may be named as a no-printing toner image (or no-printing developer image). On the other hand, another toner image (or another developer image) that is formed for printing later may be named as a printing toner image (or printing developer image).

The concentration sensor 70 is equipped with, for example, a light emitting diode (LED) which irradiates the toner image TI that is not for printing on the transfer belt 41, and a light receiving diode for receiving, among light emitted from the light emitting diode, light reflected (reflected light) by the toner image TI which is not for printing on the transfer belt. Further, the concentration sensor 70 is provided with a driving circuit, for example, driving the light emitting diode and the light receiving diode based on the control signal that is input from the control part 101 and outputting the detection signal from the light receiving diode to the control part 101. The detection signal output from the light receiving diode relates to the strength $I_R$ of the reflection light having a correlation with the density of the toner image TI which is not for printing. Therefore, the concentration sensor 70, for example, detects the strength $I_R$ of the reflection light, which is a physical quantity having a correlation with the density of the toner image TI which is not for printing. The concentration sensor 70 is arranged at a position facing the transfer belt 41. The concentration sensor 70, for example, is arranged more downstream than the primary transfer roller 44 and more upstream than the secondary transfer roller 46 in the rotational direction F2 of the transfer belt 41.

(Control Mechanism)

Figure 3:
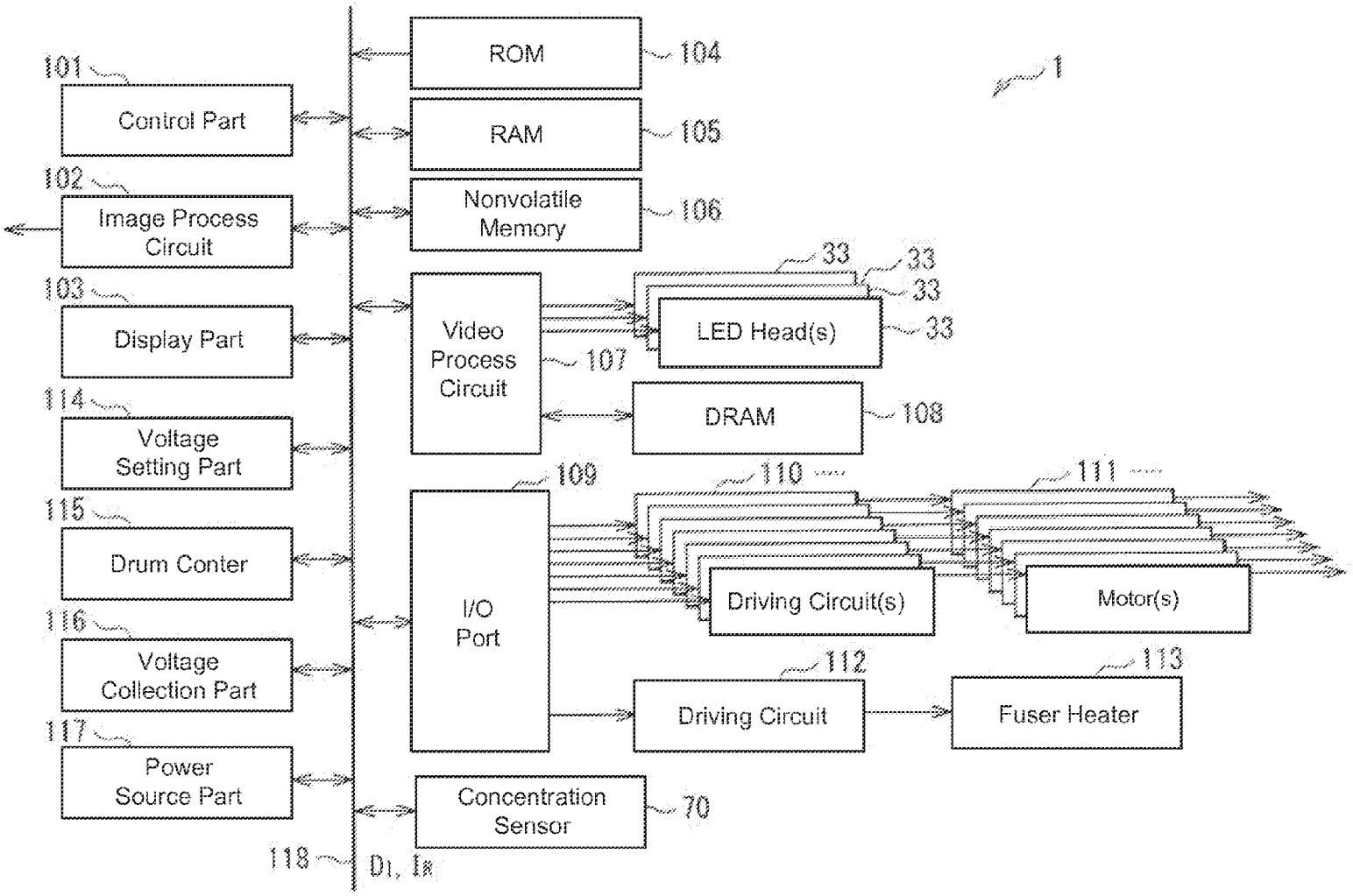
FIG. 3 is a schematic view showing one example of a control mechanism of an image forming apparatus of FIG. 1.

Next, the control mechanism of the image forming apparatus 1 will be explained with reference to FIG. 1 and FIG. 3. FIG. 3 shows an example of the control mechanism of the image forming apparatus 1 as a block diagram.

As shown in FIG. 1 and FIG. 3, the image forming apparatus 1 includes, for example, a control part 101, an image process circuit 102, a display part 103, a ROM 104, a RAM 105, and a nonvolatile memory 106 as control mechanisms. The control part 101 corresponds to one specific example of the "control part" of the present invention. The nonvolatile memory 106 corresponds to one specific example of the "memory part" of the present invention.

The control part 101, for example, controls various components to be controlled in the image forming apparatus 1 via a control line 118. The image process circuit 102 fetches the image data being sent from an external image transfer device connected to the image forming apparatus 1 and converts them into a printable data format. The display part 103, for example, displays the state of the image forming apparatus 1, and displays information for prompting a user to perform an action. OM 104 is a memory part for storing a control program for operating the image forming apparatus 1.

RAM 105 is a memory part for storing a work needed to operate the image forming apparatus 1. The nonvolatile memory 106 is a nonvolatile memory part for storing information to be stored even when the power source is lost when operating the image forming apparatus 1. In the nonvolatile memory 106, for example, one or a plurality of voltage setting formulas 120, a target value Dg, and one or a plurality of setting values $V_{34S}$ are stored.

Figure 4:
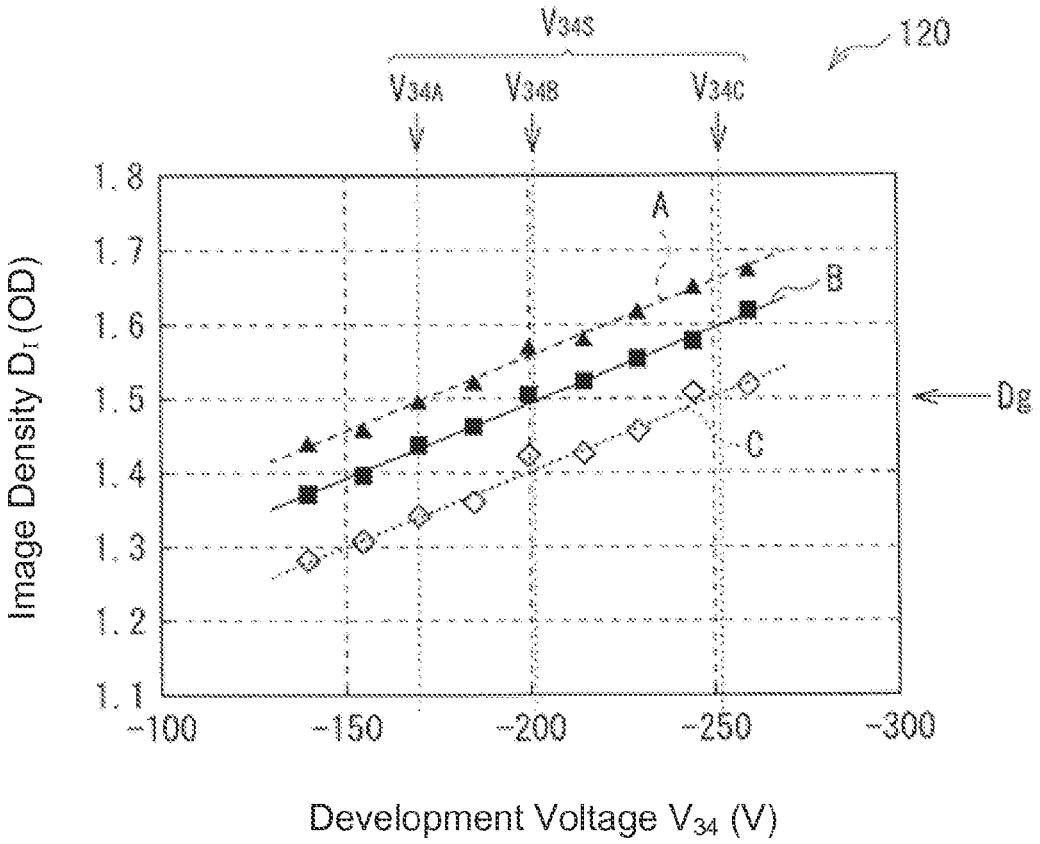
FIG. 4 is a diagram showing one example of a relationship between a development voltage and an image density.

Next, the voltage setting formula 120 will be explained. FIG. 4 shows an example of the relationship between a development voltage $V_{34}$ applied to the development roller 34 and the image density $D_I$. The image density $D_I$ shows the reflection density of the toner image TI on the transfer belt 41 with an OD value, which is an indicator of the optical density. In FIG. 4, the voltage setting formulas 120 of three types of image forming units having different values of the image density $D_I$ to the development voltage $V_{34}$ from each other are shown by three lines (dashed line A, solid line B, dotted line C). The image forming unit of the dashed line A has a tendency that the image density $D_I$ becomes high in comparison to the image forming unit of the solid line B). The image forming unit of the dotted line C has a tendency that the image density $D_I$ becomes low in comparison to the image forming unit of the solid line B. The image forming unit 30Y, for example, corresponds to any one of the image forming units among the dashed line A, the solid line B, and the dotted line C. The image forming unit 30M, for example, corresponds to any one of the image forming units among the dashed line A, the solid line B, and the dotted line C. The image forming unit 30C, for example, corresponds to any one of the image forming units among the dashed line A, the solid line B, and the dotted line C. The image forming unit 30K, for example, corresponds to any one of the image forming units among the dashed line A, the solid line B, and the dotted line C.

The meaning of the voltage setting formula 120 will be explained. There are various reasons that the image density $D_I$ varies for each of the image forming units. For example, when the surface roughness of the development roller 34 is large, the toner 37 adhering on the development roller 34 becomes thick, and it becomes easy for the toner 37 to adhere to the photosensitive drum 31. Therefore, such an image forming unit has a tendency that the image density $D_I$ becomes high. It is preferable that the variations of the image density $D_I$ are small. To reduce the image density $D_I$, it is necessary to increase the accuracy of the dimensional tolerance of the components such as the development roller 34 or to reduce the variations of the surface roughness of the structural components such as the development roller 34. However, in such a case, there is a large increase in the cost. Therefore, as shown in FIG. 4, using the approximately proportional relationship of the development voltage $V_{34}$ and the image density $D_I$ within a limited range, by adjusting the development voltage $V_{34}$, the image density $D_I$ can be adjusted to the target value Dg. In such a case, the varying of the image density $D_I$ can be suppressed even when the accuracy of the dimensional tolerance of the structural components such as the development roller 34 is not so high or the varying of the surface roughness of the structural components such as the development roller 34 is relatively large. For example, in the example of FIG. 4, when the target value Dg of the image density $D_I$ is adjusted to an OD value of 1.5, in the image forming unit of the dashed line A, −170 volts ($=V_{34A}$) is set as the setting value $V_{34S}$ of the development voltage $V_{34}$, and in the image forming unit of the solid line B, −205 volts ($=V_{34B}$) is set as the setting value $V_{34S}$ of the development voltage $V_{34}$, and in the image forming unit of the dotted line C, −255 volts ($=V_{34C}$) is set as the setting value $V_{34S}$ of the development voltage $V_{34}$. The specific deriving methods and utilization methods of the voltage setting formula 120 will be explained in detail later.

The nonvolatile memory 106 stores, for example, a correction table 130 or a plurality of thresholds Nc_th that are different from each other.

The correction table 130 corresponds to one specific example of the "correction table" of the present invention. The threshold Nc_th corresponds to one specific example of the "first threshold" of the present invention.

Next, the correction table 130 will be explained. FIG. 5 shows an example of a correction table 130. In the correction table 130, the correction value of the development voltage $V_{34}$ is set for each range of the development voltage $V_{34}$ at the start of printing. In the correction table 130, the range of the continuous print count Nc is divided into a plurality of ranges Ac1 by a plurality of thresholds Nc_th. The range Ac1 corresponds to one specific example of the "first range" of the present invention. For example, the range of the continuous print count Nc is divided into six ranges Ac1 by five thresholds Nc_th. The five thresholds Nc_th are, for example, 1,000 counts, 1,500 counts, 2,000 counts, 2,500 counts, and 3,000 counts. The six ranges Ac1 are, for example, "a range of 500 counts or more, and less than 1,000 counts (range Ac1(1))", "a range of 1,000 counts or more and less than 1,500 counts (range Ac1(2))", "a range of 1,500 counts or more and less than 2,000 counts (range Ac1(3))", "a range of 2,000 counts or more and less than 2,500 counts (range Ac1(4))", "a range of 2,500 counts or more and less than 3,000 counts (range Ac1(5))", and "a range of 3,000 counts or more (range Ac1(6))".

Further, in the correction table 130, the setting range of the development voltage $V_{34}$ is divided into a plurality of ranges Ac2. The range Ac2 corresponds to one specific example of the "second range" of the present invention. For example, the setting range of the development voltage $V_{34}$ is divided into three ranges Ac2. The three ranges Ac2 are, for example, "a range in which $|V_{34}|$ is lower than 180 volts (range Ac2(1))", "a range in which $|V_{34}|$ is 180 volts or higher and lower than 230 volts (range Ac2(2))", and "a range in which $|V_{34}|$ is 230 volts or higher (range Ac2(3))".

Further, in the correction table 130, a correction value of the development voltage $V_{34}$ will be assigned for each of the divided ranges Ac1.

For example, in the range Ac2(1), +17 volts is assigned as the correction value of the development voltage $V_{34}$ for the range Ac1(1). In the range Ac1(2), +34 volts is assigned as the correction value of the development voltage $V_{34}$. In the range Ac1(3), +51 volts is assigned as the correction value of the development voltage $V_{34}$. In the range Ac1(4), +68 volts is assigned as the correction value of the development voltage $V_{34}$. In the range Ac1(5), +85 volts is assigned as the correction value of the development voltage $V_{34}$. In the range Ac1(6), +102 volts is assigned as the correction value of the development voltage $V_{34}$.

In the correction table 130, further, the correction value of the development voltage $V_{34}$ is assigned to each of the divided ranges Ac2. For example, in the range Ac1(1), for the range Ac1(1), +17 volts is assigned as the correction value of the development voltage $V_{34}$. In the range Ac2(2), +12 volts is assigned as the correction value of the development voltage $V_{34}$. In the range Ac2(3), +8 volts is assigned as the correction value of the development voltage $V_{34}$.

In each range Ac1 in the correction table 130, the correction value for the development voltage $V_{34}$ is different for each of the ranges Ac2. Further, in each range Ac1 in the correction table 130, the absolute value of the correction value for the development voltage $V_{34}$ is larger as the range Ac2 is low. For example, in the range Ac1(1), +8 volts is assigned as the correction value of the development voltage $V_{34}$. for the range Ac1(3). In the range Ac2(2), +12 volts (>+8 volts) is assigned as the correction value of the development voltage $V_{34}$. In the range Ac2(1), +17 volts (>+12 volts) is assigned as the correction value of the development voltage $V_{34}$.

Figure 6:
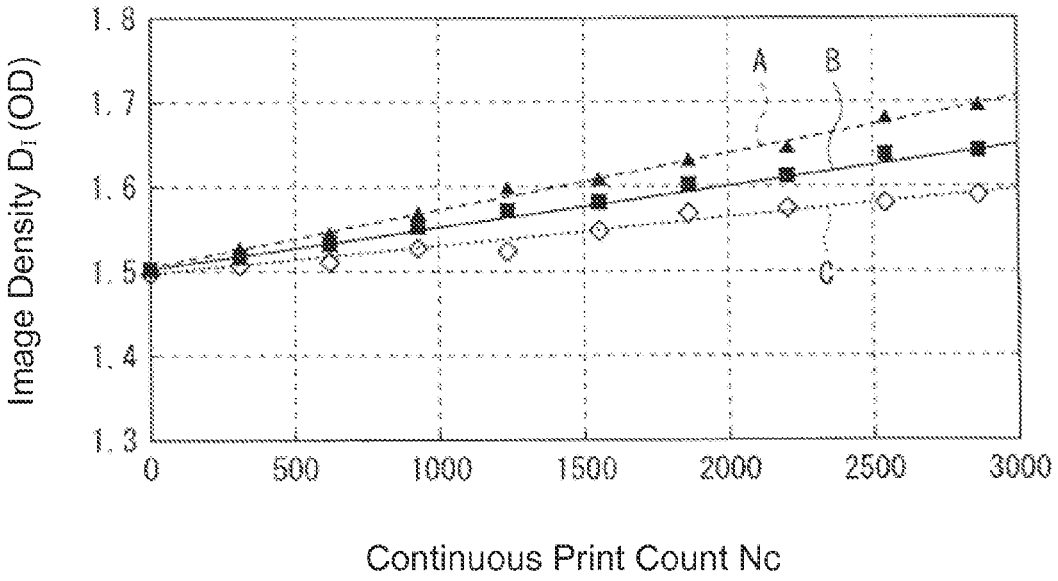
FIG. 6 is a diagram showing one example of the changes in image density due to continuous printing.

The meaning of the correction table 130 will be explained. FIG. 6 shows an example of the changes in the image density $D_I$ due to continuous printing. In FIG. 6, the changes in the image densities $D_I$ of three types of image forming units in which the changes of the image density $D_I$ to the continuous print count Nc are different from each other are shown by three lines (dashed line A, solid line B, dotted line C). From the three lines in FIG. 6, it can be understood that the image density $D_I$ increases according to the increase in the continuous print count Nc. Further, from the three lines of FIG. 6, it can be understood that the slope of the increase of the image density $D_I$ is different for each image forming unit. The difference in the slope of the increase of the image density $D_I$ for each image forming unit may be caused by the property variations of the image forming units. For example, in an image forming unit in which the surface roughness of the development roller 34 is large and having the tendency for the image density $D_I$ to increase, the effect on the surface potential of the toner 37 that adheres to the development roller 34 when the charge amount of the toner 37 changes is large. Therefore, it can be thought that, such an image forming unit has a tendency that the image density $D_I$ is likely to increase by continuous printing.

For example, in the image forming unit of the dashed line A, as a result of continuous printing, the OD value increases from 1.50 to 1.62 when the continuous count Nc goes up from 0 to 1,600. For example, when 1,000 copies of the same image pattern label are printed while the continuous print count Nc goes from 0 to 1,600, the color of the image gradually changes and the difference in hues is significant between the first label and the $1{,}000^{th}$ label. Therefore, even during continuous printing, by adjusting the process conditions (e.g., the development voltage $V_{34}$), the change in the image density $D_I$ can be suppressed to a minimum. The permitted range of the difference in hue is different for users and the purposes for utilization. However, to avoid being able to notably discern the difference in hues, it is preferred that the difference in the image density $D_I$ is within the OD value of 0.05.

As a method of adjusting the image density $D_I$ to the target value, it is considered to adjust the development voltage $V_{34}$ using the aforementioned voltage setting formula 120. However, as explained later, continuous printing needs to be interrupted to utilize the aforementioned voltage setting formula 120. However, when the continuous print count Nc during continuous printing is within each range Ac1 of the correction table 130, instead of utilizing the aforementioned voltage setting formula 120, the development voltage $V_{34}$ can be adjusted using the correction table 130. That is, by using the correction table 130, the development voltage $V_{34}$ can be adjusted without interrupting the continuous printing. Further, the specific utilization method of the correction table 130 will be explained in detail later.

The nonvolatile memory 106, for example, stores the threshold Nt_th. The threshold Nt_th is a bigger value than the threshold Nc_th. In the nonvolatile memory 106, for example, as a detection result of a later explained drum counter 115, a later explained continuous print count Nc and a later explained accumulation count Nt are stored. In the detection result of the drum counter 115, for example, the rotation number of the photosensitive drum 31 or a physical quantity having a correlation with the rotation number of the photosensitive drum 31 is included. The threshold Nt_th corresponds to one specific example of the "second threshold" of the present invention. The rotation number of the photosensitive drum 31 corresponds to an example of the "rotation number of the photosensitive drum" of the present invention. A physical quantity correlating to the rotation number of the photosensitive drum 31 is defined as "the second physical quantity" of the present invention. The rotation number of the photosensitive drum 31 itself is included in the second physical quantity. The threshold Nt_th, the rotation number of the photosensitive drum 31, the physical quantity correlating to the rotation number of the photosensitive drum 31, the continuous print count Nc and the accumulation count Nt will be explained later.

Again, the control mechanism of the image forming apparatus 1 will be explained. Further, the image forming apparatus 1 is provided with, as a control mechanism, for example, a video process circuit 107, four LED heads 32, a DRAM 108, an I/O port 109, a plurality of driving circuits 110, a plurality of motors 111, a driving circuit 112, a fuser heater 113, and a concentration sensor 70. Further, the image forming apparatus 1 is provided with, as a control mechanism, for example, a voltage setting part 114, a drum counter 115, a voltage correction part 116, and a power source part 117. The voltage setting part 114 corresponds to one specific example of the "setting part" of the present invention. The drum counter 115 corresponds to one specific example of the "second detection part" of the present invention. The voltage correction part 116 corresponds to one specific example of the "correction part" of the present invention. The power source part 117 corresponds to one specific example of the "power source part" of the present invention.

The video process circuit 107 outputs the image data obtained by the data conversion in the image process circuit 102 to each LED head 33. The DRAM 108 is a memory part for storing the image data once before it is output from the video process circuit 107. The I/O port 109 outputs the control signals for driving various driving motors 111 to various driving circuits 110. Further, the I/O port 109 outputs the control signals for driving the fuser heater 113 to the driving circuit 112. The driving circuit 110 performs a pulse control of the motor 111 for rotating various rollers. The driving circuit 110 for the photosensitive drum 31 performs the pulse control of the motor 111 for rotating the photosensitive drum 31.

The driving circuit 112 performs a pulse control of the fuser heater 113. The fuser heater 113 is provided inside each of the upper roller 51 and the lower roller 52 and heats the upper roller 51 and the lower roller 52. The fuser heater 113 is, for example, a heater such as a halogen lamp, etc.

The voltage setting part 114 performs a setting of the development voltage $V_{34}$ to be applied on the development roller 34 based on the density of the toner image TI which is not for printing or a physical quantity correlating to the density detected by the concentration sensor 70. The voltage setting part 114 performs a setting of the development voltage $V_{34}$ to be applied on the development roller 34 based on the detection signals output from the concentration sensor 70. The voltage setting part 114 performs a setting of the development voltage $V_{34}$ to be applied to the development roller 34 for each of the image forming units 30Y, 30M, 30C, and 30K. The voltage setting part 114 stores the development voltage $V_{34}$ set for each of the image forming units 30Y, 30M, 30C, and 30K in the nonvolatile memory 106 as the setting value $V_{34S}$. Further, the voltage setting part 114 performs a setting of the development voltage $V_{34}$ to be applied to the development roller 34 for any of the image forming units 30Y, 30M, 30C, and 30K using a common method. Therefore, hereinafter, a method for setting the development voltage $V_{34}$ to be applied to the development roller 34 of the image forming unit 30Y will be explained as a representative for the image forming units 30Y, 30M, 30C, and 30K.

The voltage setting part 114, for example, performs a setting of the development voltage $V_{34}$ to be applied on the development roller 34 of the image forming unit 30Y in the following manner. First, the voltage setting part 114, while changing the development voltage $V_{34}$ to be applied to the development roller 34 of the image forming unit 30Y, derives the voltage setting formula 120 based on the detection signals obtained from each of the three toner images TI not for printing that are formed on the transfer belt 41.

For example, it is supposed that the detection signal obtained when the development voltage $V_{34}$ is set to ~140V is a signal corresponding to the OD value 1.45. It is also supposed that the detection signal obtained when the development voltage $V_{34}$ is set to ~200V is a signal corresponding to the OD value 1.55. It is also supposed that the detection signal obtained when the development voltage $V_{34}$ is set to ~260V is a signal corresponding to the OD value 1.65. The voltage setting part 114 derives an approximate straight line from the three setting values $V_{34S}$ of the development voltage $V_{34}$ and the three measured values of the OD value. The approximate straight line can be, for example, expressed by the voltage setting formula 120 corresponding to the dashed line A of FIG. 4. Next, the voltage setting part 114 derives the development voltage $V_{34}$ corresponding to the target value Dg of the OD value set by a user using the derived approximate straight line. For example, when the target value Dg of the image density $D_I$ is adjusted to an OD value of 1.5, the voltage setting part 114 uses the voltage setting formula 120 corresponding to the dashed line A of FIG. 4 to set, for example, ~170 volts ($=V_{34A}$) as the setting value $V_{34S}$ of the development voltage $V_{34}$ corresponding to the target value Dg.

The drum counter 115 detects the rotation number of the photosensitive drum 31 or a physical quantity having a correlation with the rotation number of the photosensitive drum 31. The rotation number of the photosensitive drum 31 corresponds to one specific example of the "number of rotation of the photosensitive drum" of the present invention. A physical quantity correlating to the rotation number of the photosensitive drum 31 corresponds to one specific example of the "second physical quantity" of the present invention. The drum counter 115 measures the continuous print count Nc and the accumulation count Nt during a predetermined period. The drum counter 115 stores the continuous print count Nc and the accumulation count Nt obtained from the measurement in the nonvolatile memory 106. The initial value of the continuous print count Nc and the accumulation count Nt, for example, is zero. The drum counter 115 initializes the continuous print count Nc stored in the nonvolatile memory 106 to the initial value when printing is stopped or started. The drum counter 115 initializes the accumulation count Nt stored in the nonvolatile memory 106 to the initial value when a later explained density correction is executed.

Here, the predetermined period of time refers to the time between when the setting value $V_{34S}$ set by the voltage setting part 114 is applied to the development roller 34 as the development voltage $V_{34}$ and when the printing is stopped. The continuous print count Nc and the accumulation count Nt, for example, refer to the pulse number of the driving pulse signals output to a motor 111 when the driving circuit 110 performs a pulse control of the motor 111 for rotating the photosensitive drum 31. At this time, the continuous print count Nc and the accumulation count Nt are examples of the physical quantity correlating to the rotation number of the photosensitive drum 31. Further, at this time, the drum counter 115 measures the pulse number of the aforementioned driving pulse signal. Further, the continuous print count Nc and the accumulation count Nt can be different from the aforementioned pulse number of the driving pulse signal as long as it is the rotation number of the photosensitive drum 31 or a physical quantity having a correlation with the rotation number of the photosensitive drum 31.

The continuous print count Nc and the accumulation count Nt, for example, can be added one by one every time the photosensitive drum 31 rotates once. At this time, the continuous print count Nc and the accumulation count Nt equal the rotation number of the photosensitive drum 31. Further, at this time, the drum counter 115, for example, detects a marker provided at a predetermined place on the photosensitive drum 31 once for every revolution of the photosensitive drum 31 and adds 1 to the continuous print count Nc and the accumulation count Nt every time the aforementioned marker is detected.

Further, the continuous print count Nc shown in the drawing is added one by one every time the photosensitive drum 31 rotates once. When the continuous print count Nc is added one by one every time the photosensitive drum 31 rotates once, 1 count corresponds to the image forming distance of 94.2 mm per rotation when the diameter of the photosensitive drum 31 is 30 mm. When the longitudinal feed of A6 size is 148 mm and the interval of the labels is 3 mm, 1.6 is added to the continuous print count Nc every time one label is printed. Therefore, when 1,000 copies of a A6 size label were printed, the continuous print count Nc will be 1,600 counts.

As described above, the continuous print count Nc is the rotation number of the photosensitive drum 31 or a physical quantity having a correlation with the rotation number of the photosensitive drum 31. Therefore, the drum counter 115 measures the continuous print count Nc as the rotation number of the photosensitive drum 31 or a physical quantity having a correlation with the rotation number of the photosensitive drum 31. The drum counter 115 can measure the rotation number of the photosensitive drum 31 or a physical quantity having a correlation with the rotation number of the photosensitive drum 31 using methods other than the methods described above. Further, hereinafter, "the rotation number of the photosensitive drum 31 or a physical quantity having a correlation with the rotation number of the photosensitive drum 31" is referred to as the "measurement result by the drum counter 115".

The voltage correction part 116 corrects the development voltage $V_{34}$ set by the voltage setting part 114 based on the measurement result of the drum counter 115. The voltage correction part 116 performs the aforementioned correction every time the measurement result by the drum counter 115 exceeds one threshold Nc_th1.

The voltage correction part 116, for example, performs the aforementioned correction using the correction table 130. The voltage correction part 116 fetches a correction value assigned to a range Ac1 in which the measurement result of the drum counter 115 belongs to from the correction table 130 in the nonvolatile memory 106 and performs the aforementioned correction using the fetched correction value. Further, the voltage correction part 116, for example, fetches a correction value assigned to a range Ac2 in which the measurement result of the drum counter 115 belongs to from the correction table 130 in the nonvolatile memory 106 and performs the aforementioned correction using the fetched correction value.

The power source part 117 applies the charged voltage $V_{32}$ to the charge roller. The power source part 117 further applies the development voltage $V_{34}$ to the development roller 34 and applies the supply voltage $V_{35}$ to the supply roller 35. The power source part 117 applies the development voltage $V_{34}$ set by the voltage setting part 114 to the development roller 34 at a predetermined timing directed by the control part 101. The power source part 117 applies the development voltage $V_{34}$ corrected by the voltage correction part 116 to the development roller 34 at a predetermined timing directed by the control part 101. When the development voltage $V_{34}$ is corrected by the voltage correction part 116, the power source part 117 applies the development voltage $V_{34}$ after the correction (or corrected development voltage $V_{34}$) to the development roller 34 during continuous printing. The power source part 117 changes the development voltage $V_{34}$ to be applied to the development roller 34 from the development voltage $V_{34}$ before the correction to the development voltage $V_{34}$ after the correction during continuous printing. That is, the control part 101 controls the power source part 117 so as to change the development voltage $V_{34}$ before the correction to the development voltage $V_{34}$ after the correction during continuous printing without stopping the printing. The power source part 117 applies the most recently updated development voltage $V_{34}$ (that is, the development voltage $V_{34}$ before the next correction is made) to the development roller 34 until the time of the next correction by the voltage correction part 116.

The control part 101 stops the printing every time the detection result by the drum counter 115 exceeds the threshold Nc_th2. Further, the control part 101 controls the image forming part 30 and the transfer part 40 so as to form a plurality of toner images TI that are not for printing and having different development voltages $V_{34}$ on the transfer belt 41 while the printing is stopped. At this time, every time the printing is stopped, the voltage correction part 116 initializes the measurement results by the drum counter which are stored in the nonvolatile memory 106. The concentration sensor 70 performs the detection of the density of the toner image TI on the transfer belt 41 that is not for printing or the physical amount correlating to the density while the printing is stopped. The voltage setting part 114 performs a setting of the development voltage $V_{34}$ to be applied to the development roller 34 based on the density of the toner image TI detected by the concentration sensor 70 or a physical quantity correlating to the density every time the detection by the concentration sensor 70 is performed. The control part 101 starts the printing after the setting of the development voltage $V_{34}$ by the voltage setting part 114 is performed. Every time the development voltage $V_{34}$ is reset by the voltage setting part 114, the power source part 117 applies the development voltage $V_{34}$ after the reset to the development roller 34.

[Operation] Next, the operation of the image forming apparatus 1 will be explained. In the image forming apparatus 1, a toner image TI is formed on a medium P in the following manner. When a print job is supplied to the control part 101 from the image transfer device connected to the image forming apparatus 1 via a communication line, the control part 101 executes the print process based on the print job so that each member in the image forming apparatus 1 performs the following operation.

First, the heating of the upper roller 51 and the lower roller 52 by the fuser heater 113 is started. When the upper roller 51 and the lower roller 52 reach a predetermined temperature, the medium P accommodated in the medium container part 10 is taken out by the feeding roller pair 21 and fed to the carrying path PW. Next, the medium P fed to the carrying path PW is carried on the carrying path PW by the carrying roller pair 22 in the carrying direction F1, and then the skew of the medium P is corrected by the registration roller pair 23. Further, at a predetermined timing, the operations of the image forming part 30 are started, and the medium P is carried to the transfer part 40 and the toner image TI formed on the image forming part 30 is transferred onto the medium P in the following manner. In this manner, an image is printed on a medium P.

In the image forming part 30, a toner image TI is formed by the following electrophotographic process. First, since the charged voltage $V_{32}$ is applied to the charge roller 32 from the power source part 117, the surface (surface portion) of the charge roller 32 is equally charged and accordingly, a portion of the peripheral surface 31A of the photosensitive drum 31 that is in contact with the charge roller 32 is also charged to a predetermined voltage (i.e., ~600 volts). Next, among the peripheral surface 31A of the photosensitive drum 31, since irradiation light is irradiated from the LED heads 33 toward the charged regions to thereby expose the peripheral surface 31A of the photosensitive drum 31, the electrostatic latent image according to the print pattern prescribed by the aforementioned print job is formed on the peripheral surface 31A. At this time, among the peripheral surface 31A of the photosensitive drum 31, the voltage of the portion corresponding to the electrostatic latent image is, for example, roughly 0 volt.

On the other hand, when the supply voltage $V_{35}$ is applied to the supply roller 35 from the power source part 117, the surface of the supply roller 35 (surface layer portion) becomes the predetermined voltage (e.g., ~300 volts). Similarly, when the development voltage $V_{34}$ is applied to the development roller 34 from the power source part 117, the surface of the development roller 34 (surface layer portion) becomes the predetermined voltage (e.g., ~205 volts). At this time, the supply roller 35 is in contact with the development roller 34 and the supply roller 35 and the development roller 34 rotate at the predetermined respective peripheral speeds. With this, a negatively charged toner 37 is pulled to the development roller 34 by the potential difference between the voltage $V_{35}$ of the supply roller 35 and the voltage $V_{34}$ of the development roller 34. As a result, the toner 37 is supplied to the surface of the development roller 34 from the surface of the supply roller 35. Next, the toner 37 on the development roller 34 is charged by the friction, etc., of the regulating blade 38 in contact with the development roller 34. Here, the thickness of the toner 37 on the development roller 34 is determined by the development voltage $V_{34}$ of the development roller 34, the supply voltage $V_{35}$ of the supply roller 35, the pushing pressure of the regulating blade 38, etc. Further, the development roller 34 is in contact with the photosensitive drum 31 and the development roller 34 and the photosensitive drum 31 rotate at the predetermined respective peripheral speeds. With this, a negatively charged toner 37 is pulled toward the photosensitive drum 31 by the potential difference between the development voltage $V_{34}$ of the development roller 34 and the voltage of a portion corresponding to the electrostatic latent image among the peripheral surface 31A of the photosensitive drum 31. As a result, the toner 37 adheres to the electrostatic latent image on the photosensitive drum 31. Furthermore, among the peripheral surface 31A of the photosensitive drum 31, the negatively charged toner 37 is not pulled toward the charged region since the voltage of the portion corresponding to the charge region is lower than the development voltage $V_{34}$ of the development roller 34.

After that, the toner image TI on the photosensitive drum 31 is transferred onto the transfer belt 41 by the electric field between the photosensitive drum 31 and the primary transfer rollers 44. Further, the toner 37 that remained on the surface of the photosensitive drum 31 is removed by being scraped off by the cleaning blade 39. Next, the toner image TI on the transfer belt 41 is transferred onto the medium P by the electric field between the opposing roller 45 and the secondary transfer roller 46. The toner 37 that remained on the surface of the transfer belt 41 is removed by being scraped off by the cleaning blade 39. After that, by the fuser part 50, the toner image TI fuses to the medium P by heat and pressure applied to the toner image TI on the medium P.

Next, the operation of the image forming apparatus 1 will be explained in detail. Hereinafter, specifically, the operations of the image forming apparatus 1 when setting and/or correcting the development voltage $V_{34}$ of the development roller 34 will be explained in detail.

Figure 7:
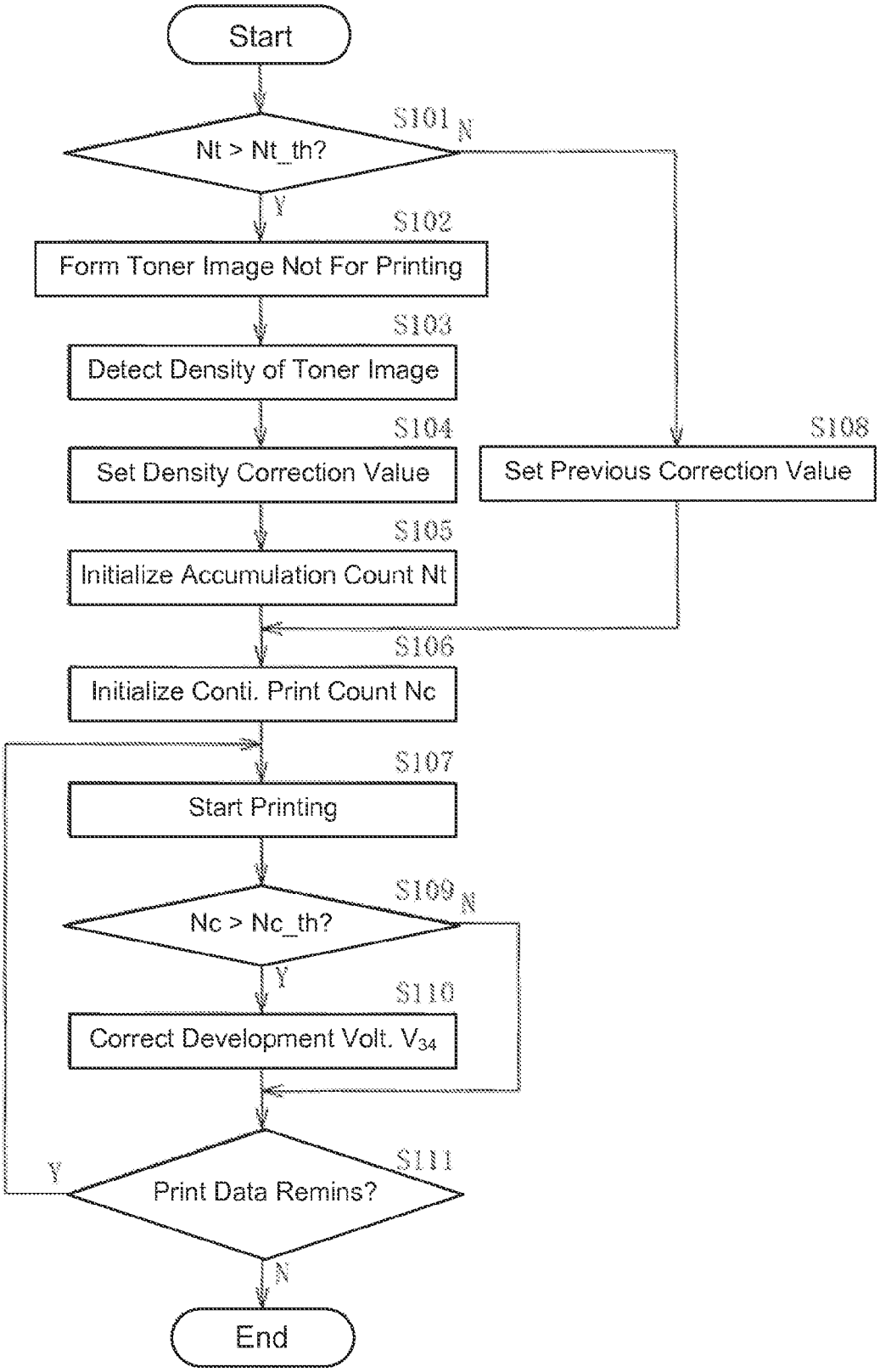
FIG. 7 is a flow diagram showing one example of the operation procedure of the image forming apparatus of FIG. 1.

FIG. 7 shows an example of the operation procedure of the image forming apparatus 1. First, a print job is supplied to the control part 101 from an image transfer device connected to the image forming apparatus 1 via a communication line. Then, the control part 101 executes the print process based on the print job so that each member in the image forming apparatus 1 performs the following operation.

First, the control part 101 judges whether or not the detection result (accumulation count Nt) by the drum counter 115 exceeds the threshold Nt_th (S101). When the accumulation count Nt exceeds the threshold Nt_th, the control part 101 executes the density correction.

Specifically, the control part 101 first instructs each image forming unit 30Y, 30M, 30C, and 30K of the image forming part 30 to form three toner images TI which are not for printing and having different development voltages $V_{34}$ from each other. With this, three toner images TI which are not for printing and having different development voltages $V_{34}$ from each other are formed on the peripheral surface 31A of the photosensitive drum 31 of each image forming unit 30Y, 30M, 30C, and 30K. Further, the control part 101 instructs the image forming part 30 and the transfer part 40 to transfer each toner image TI which are not for printing and formed by the image forming part 30 to the transfer belt 41. With this, each toner image TI on the peripheral surface 31A which is not for printing is transferred to the transfer belt 41. In this way, each toner image TI which is not for printing is formed on the transfer belt 41 (S102).

Next, the control part 101 instructs the concentration sensor 70 to measure the density. With that, light is irradiated from the concentration sensor 70 to each of the toner images TI on the transfer belt 41 that are not for printing, and the reflected light from each of the toner images TI is detected by the concentration sensor 70. As a result, detection signals relating to the strength of $I_R$ of the reflected light from each of the toner images TI is output from the concentration sensor 70. In this way, the density of each of the toner images TI or the physical quantity correlating to the density is detected (S103).

Next, the control part 101 derives the voltage setting formula 120 of each of the image forming units 30Y, 30M, 30C, and 30K based on the detection signal output from the concentration sensor 70 and the development voltage $V_{34}$ applied to each of the image forming units 30Y, 30M, 30C, and 30K. Further, the control part 101 derives a setting value $V_{34S}$ of the development voltage $V_{34}$ corresponding to the target value Dg for each of the image forming units 30Y, 30M, 30C, and 30K using the derived voltage setting formula 120. The control part 101 stores the derived setting value $V_{34S}$ in the nonvolatile memory 106. In this way, the density correction value is set (S104). Afterwards, the control part 101 initializes the accumulation count Nt (S105).

Next, after initializing the continuous print count Nc, the control part 101 starts printing using the derived setting value $V_{34S}$ (S106, S107).

Even when the accumulation count Nt does not exceed the threshold Nt_th, after initializing the continuous print count Nc, the control part 101 starts printing using the derived setting value $V_{34S}$ (S106, S107). However, when the accumulation count Nt does not exceed the threshold Nt_th, the previous density correction value is set (S108). At the time of printing, the control part 101 instructs the output of the development voltage $V_{34}$ of the derived setting value $V_{34S}$ to the power source part 117. With this, the development voltage $V_{34}$ of the derived setting value $V_{34S}$ is applied to the development roller 34.

Next, the control part 101 corrects the development voltage $V_{34}$ based on the continuous print count Nc measured by the drum counter 115. Specifically, the control part 101 judges whether or not the continuous print count Nc measured by the drum counter 115 exceeds the threshold Nc_th (S109). When the continuous print count Nc exceeds the threshold Nc_th, the control part 101 instructs the voltage correction part 116 to correct the development voltage $V_{34}$. With this, the correction value assigned to the range Ac1 in which the continuous print count Nc belongs to, which is the correction value assigned to the range Ac2 in which the setting value $V_{34S}$ of the development voltage $V_{34}$ belongs to is fetched from the correction table 130. Then, the development voltage $V_{34}$ is corrected using the fetched correction value (S110). For example, a correction value fetched from the correction table 130 is added to the development voltage $V_{34}$. When the continuous print count Nc does not exceed the threshold value Nc_th, the control part 101 does not execute the correction of the development voltage $V_{34}$.

Next, the control part 101 instructs the output of the development voltage $V_{34}$ after the correction to the power source part 117. Specifically, the control part 101 instructs the power source part 117 to change the output to the development roller 34 from the development voltage $V_{34}$ before the correction to the development voltage $V_{34}$ after the correction. With this, the output to the development roller 34 is changed from the development voltage $V_{34}$ before the correction to the development voltage $V_{34}$ after the correction. Here, the timing of the application of the development voltage $V_{34}$ after the correction in each of the image forming units 30Y, 30M, 30C, and 30K is, for example, equal to each other as shown in FIG. 8.

Figure 8:
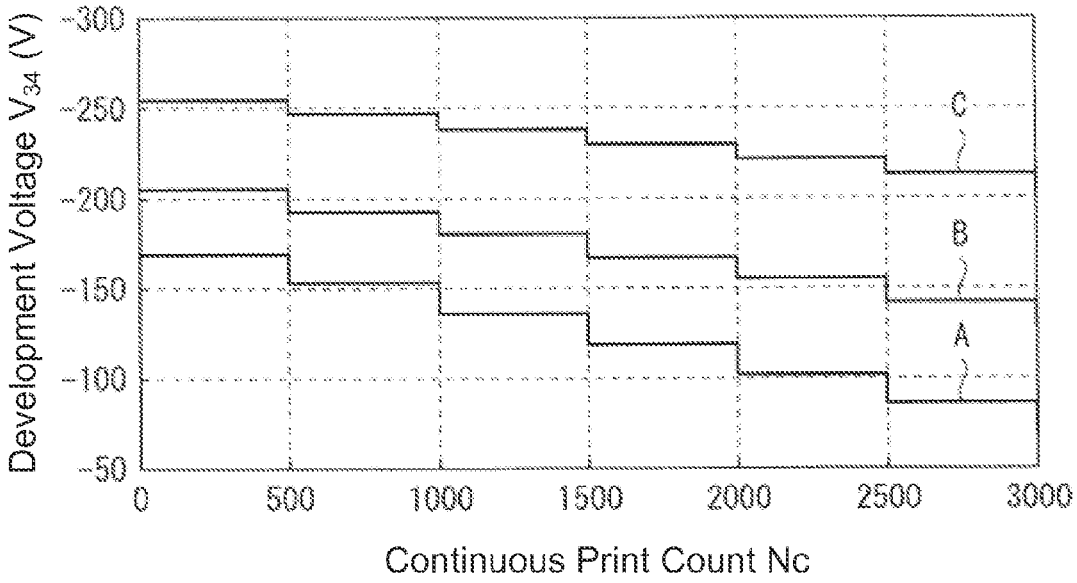
FIG. 8 is a diagram showing one example of the timing of the application of the development voltage after the correction (or corrected development voltage) in the image forming unit.

FIG. 8 shows an example of the application timing of the development voltage $V_{34}$ after the correction for the image forming units of the three lines (dashed line A, solid line B, dotted line C) as shown in FIG. 4. In FIG. 8, a manner in which the development voltage $V_{34}$ before the correction is changed to the development voltage $V_{34}$ after the correction in each of the image forming units 30Y, 30M, 30C, and 30K as the continuous print count Nc increases by 500 counts is exemplified. Also, in FIG. 8, the difference between the development voltage $V_{34}$ before and after the correction is the largest in the dashed line A in which the increase in the image density $D_I$ during continuous printing is relatively large, and smallest in the dashed line C in which the increase in the image density $D_I$ during continuous printing is relatively small.

Figure 9:
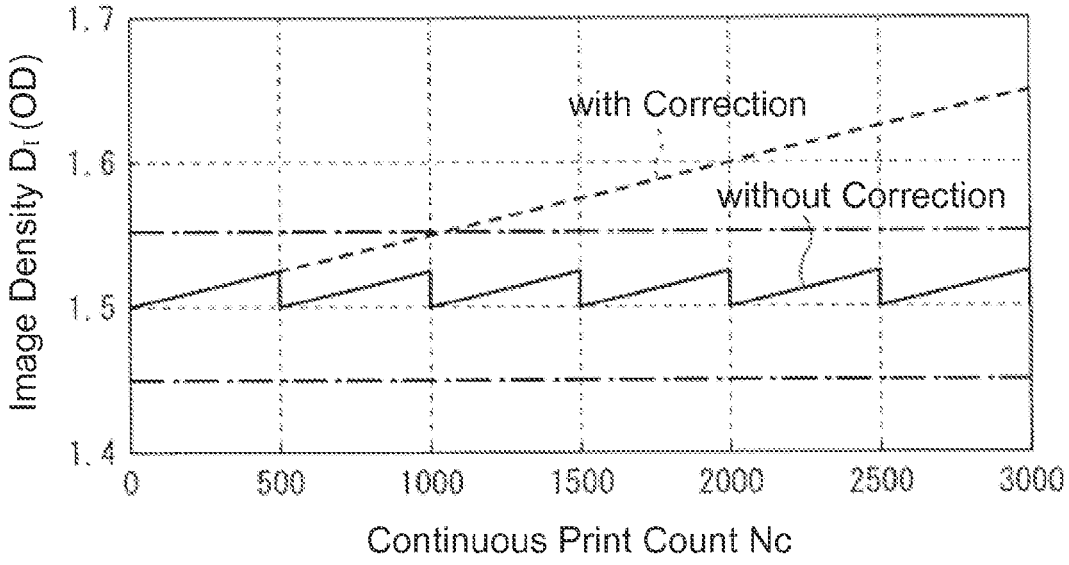
FIG. 9 is a diagram showing one example of the change in the image density between when corrections were made and when corrections were not made during continuous printing.
Figure 10:
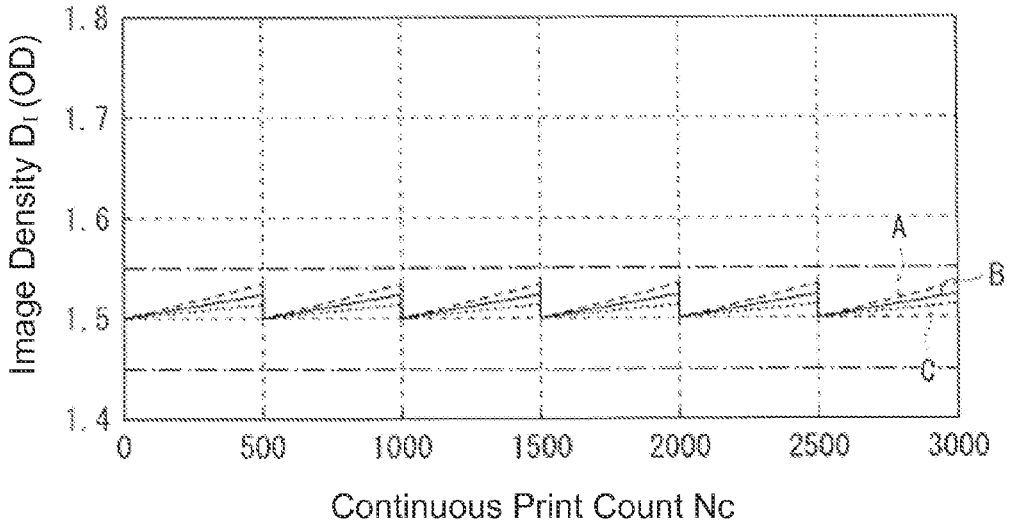
FIG. 10 is a diagram showing one example of the change in the image density when corrections were not made during continuous printing.

FIG. 9 shows an example of the change in the image density $D_I$ when the correction is not made and when it is made by the voltage correction part 116 during continuous printing in the image forming unit of the solid line B as shown in FIG. 4. FIG. 10 shows an example of the change in the image density $D_I$ when the correction is not made and when it is made by the voltage correction part 116 during continuous printing for the image forming units of the three lines (dashed line A, solid line B, and dotted line C) as shown in FIG. 4. From FIG. 9 and FIG. 10, it can be understood that the image density $D_I$ falls within the varying range of 0.05 since corrections are made by the voltage correction part 116 every time the continuous print count Nc increases by 500 counts.

Next, the control part 101 determines whether or not there is print data remaining (S111). When there remains no print data, the control part 101 terminates printing. When there remains print data, the control part 101 continues the printing and executes S106.

Effects

Next, the effects of the image forming apparatus 1 will be explained. Generally, in an electrographic system image forming apparatus, the amount of toner to be transferred onto a sheet is strictly controlled to faithfully reproduce the color images. For example, the developer density of the patch pattern printed on a transfer belt is measured, and the processing conditions are controlled based on the density data obtained from the measurement. However, since it is necessary to interrupt normal printing to measure the toner density of the patch pattern, the toner density of the patch pattern cannot be measured during printing. Therefore, in a case in which the continuous printing time under a processing condition that is once set becomes long, the print image density may differ from the start of the printing to when printing was performed for a long time.

However, in the image forming apparatus 1, the development voltage $V_{34}$ set before the start of printing is corrected based on the measurement result measured by the drum count 115. With this, corrections according to the rotational number of the photosensitive drum 31 can be made during continuous printing to the development voltage $V_{34}$ set before the start of printing without stopping the printing. As a result, the print image density during long printing can be stabilized. Further, since the printing can be stopped to reduce the frequency to perform the corrections of the development voltage $V_{34}$ by using the density data obtained from the concentration sensor 70, the print function of the image forming apparatus 1 can be improved.

Further, in the image forming apparatus 1, the correction table 130 is used when making corrections to the development voltage $V_{34}$ set before starting the printing. With this, not only is it possible to make corrections according to the rotational number of the photosensitive drum 31, but corrections appropriate for the variations in the properties of the image forming units can be made. As a result, the print image density during long printing can be further stabilized. Furthermore, in the image forming apparatus 1, the aforementioned density correction is not performed unless the accumulation count Nt exceeds the threshold Nc_th. Therefore, for example, when there is no need to especially perform the aforementioned density correction such as when the printing is terminated in a short time because there were not many print data, the execution of the aforementioned density correction can be omitted. As a result, unnecessary toner consumption can be avoided.

2. Modified Examples

Hereinafter, a modified example of the image transfer device 1 according to the aforementioned embodiment will be explained. Further, hereinafter, for structural elements in common with the aforementioned embodiments, the same symbols used for the aforementioned embodiments will be used. Furthermore, the structural elements different from the aforementioned embodiments will be mainly explained, and the explanations for structural elements in common with the aforementioned embodiment will be arbitrarily omitted.

Modified Example 1

In the aforementioned embodiment, corrections were made for the development voltage $V_{34}$, but corrections can be made for the supply voltage value $V_{35}$ in place of the development voltage $V_{34}$. At this time, the voltage setting part 114 performs a setting of the supply voltage $V_{35}$ based on the density detected by the concentration sensor 70, or a physical quantity correlating to the density. The voltage correction part 116 corrects the supply voltage $V_{35}$ based on the measurement result of the drum counter 115. The power source part 117 applies the supply voltage $V_{35}$ after correction (or corrected supply voltage $V_{35}$) to the supply roller 35 when a correction is made to the supply voltage $V_{35}$. Further, the details of the setting and the correction for the supply voltage value $V_{35}$ are explained by the description of the aforementioned embodiment by replacing the development voltage $V_{34}$ with supply voltage value $V_{35}$.

Modified Example 2

In the aforementioned embodiment, the corrections were made for the development voltage $V_{34}$, but corrections can be made for the supply voltage value $V_{35}$ and not just for the development voltage value $V_{34}$. At this time, the voltage setting part 114 performs a setting of the development voltage $V_{34}$ and the supply voltage value $V_{35}$ based on the density detected by the concentration sensor 70, or a physical quantity correlating to the density. The voltage correction part 116 corrects the development voltage value $V_{34}$ and the supply voltage $V_{35}$ based on the measurement result of the drum counter 115.

The power source part 117 applies the development voltage $V_{34}$ after the correction to the supply roller 35 when a correction is made to the development voltage value $V_{34}$. The power source part 117 applies the supply voltage $V_{35}$ to the supply roller 35 when a correction is made to the supply voltage $V_{35}$. Further, the details of the setting and the correction for the development voltage value $V_{34}$ and the supply voltage value $V_{35}$ is explained by the description of the aforementioned embodiment by replacing the development voltage $V_{34}$ with the development voltage $V_{34}$ and the supply voltage value $V_{35}$.

Figure 11:
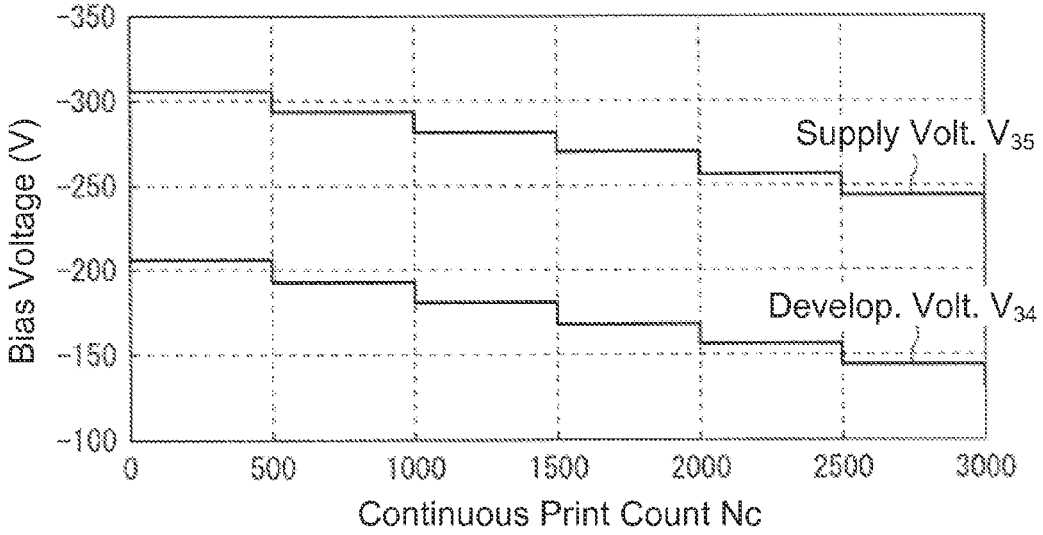
FIG. 11 is a diagram showing one example of the change in the development voltage and the supply voltage.

FIG. 11 shows an example of the change in the development voltage $V_{34}$ and the supply voltage value $V_{35}$ when corrections are made by the voltage correction part 116 to the development voltage $V_{34}$ and the supply voltage value $V_{35}$. In this variable example, when both the development voltage $V_{34}$ and the supply voltage value $V_{35}$ are corrected by the voltage correction part 116, the power source part 117, for example, as shown in FIG. 11, can apply the supply voltage value $V_{35}$ after the correction to the supply roller 35 at the same time as applying the development voltage $V_{34}$ after the correction to the development roller 34. In such a case, the control for changing the development voltage $V_{34}$ and the supply voltage value $V_{35}$ can be simplified. In this case, the potential difference between the development voltage $V_{34}$ and the supply voltage value $V_{35}$ is, for example, as shown in FIG. 11, always constant.

Figure 12:
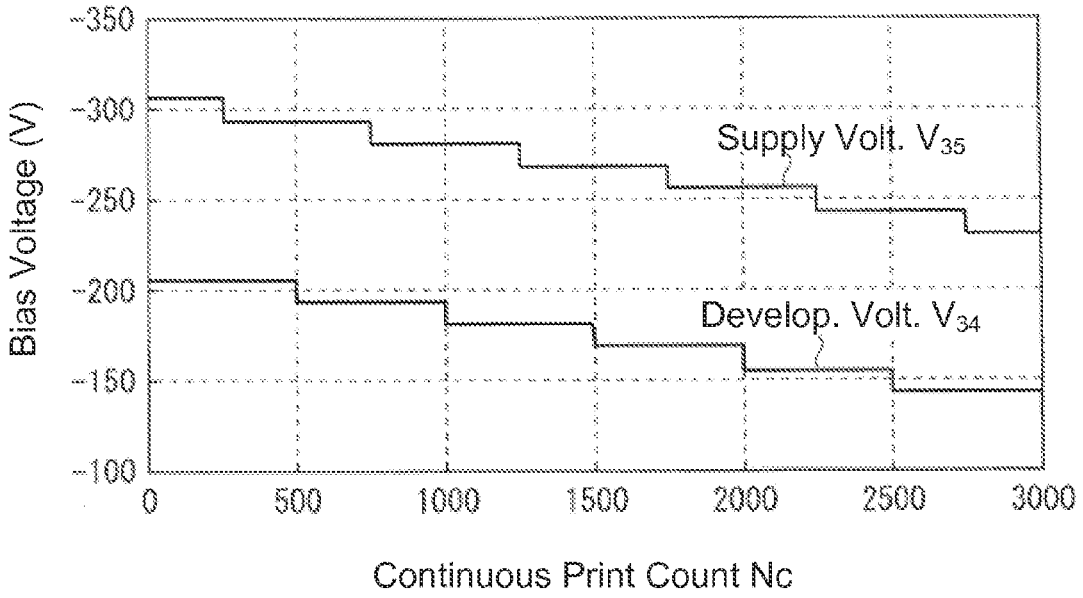
FIG. 12 is a diagram showing one example of the changes in the development voltage and the supply voltage.

FIG. 12 shows an example of the change in the development voltage $V_{34}$ and the supply voltage value $V_{35}$ when corrections were made by the voltage correction part 116 to the development voltage $V_{34}$ and the supply voltage value $V_{35}$. In this modified example, for example, when both the development voltage $V_{34}$ and the supply voltage value $V_{35}$ are corrected by the voltage correction part 116 as shown in FIG. 12, the power source part 117 can make the timing different for applying the development voltage value $V_{34}$ after the correction to the development roller 34 and for applying the supply voltage value $V_{35}$ after the correction to the supply roller 35. In this modified example, for example, when both the development voltage $V_{34}$ and the supply voltage value $V_{35}$ are corrected by the voltage correction part 116 as shown in FIG. 12, the power source part 117 can apply the development voltage value $V_{34}$ after the correction to the development roller 34 after applying the supply voltage value $V_{35}$ after the correction to the supply roller 35.

For example, when the continuous print count Nc is at 250 counts, the first correction of the supply voltage value $V_{35}$ is executed, and next, when the continuous print count Nc is at 500 counts, the first correction of the development voltage $V_{34}$ is executed. In such a case, in a period in which the continuous print count Nc is 250 counts to 500 counts, the potential difference between the supply voltage value $V_{35}$ and the development voltage $V_{34}$ is 88 volts, and when the continuous print count Nc is at 500 counts, the potential difference between the supply voltage value $V_{35}$ and the development voltage $V_{34}$ is 100 volts. In this way, by changing the potential difference of the supply voltage value $V_{35}$ and the development voltage $V_{34}$ unevenly, occurrences of big differences in the image density $D_I$ can be reduced when the development voltage $V_{34}$ after the correction is applied to the development roller 34 or when the supply voltage value $V_{35}$ after the correction is applied to the supply roller 35.

Figure 13:
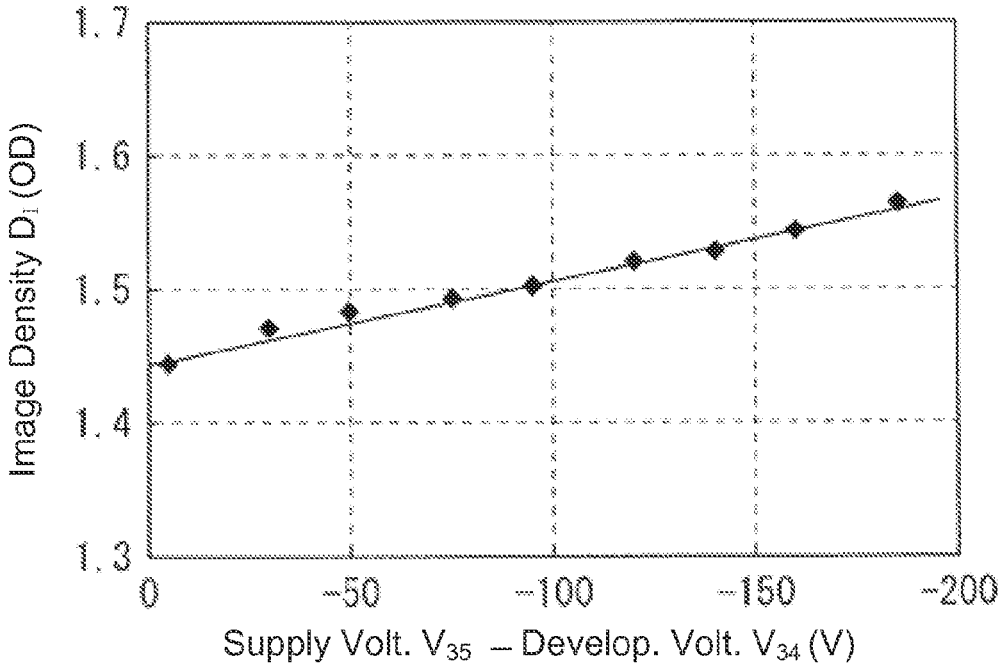
FIG. 13 is a diagram showing one example of the changes in the image density against the potential difference between the supply voltage value and the development voltage.

Next, the reason for the reduction in the difference in the image density $D_I$ will be explained. FIG. 13 shows an example of the change in the image density $D_I$ with respect to the potential difference between the supply voltage value $V_{35}$ and the development voltage $V_{34}$. Further, in FIG. 13, other image forming conditions such as the charged voltage $V_{32}$, the development voltage $V_{34}$, and exposure energy are constant. As shown in FIG. 13, as the aforementioned potential difference increases, it can be understood that the image density $D_I$ increases. When the aforementioned potential difference increases, the electric field in the direction toward the development roller 34 from the supply roller 35 becomes bigger. As a result, it is considered that, since the amount of the negatively charged toner 37 that is carried to the development roller 34 from the supply roller 35 increases, the thickness of the toner 37 on the development roller 34 increases, and the image density $D_I$ also increases.

In this modified example, the aforementioned properties can be utilized by unevenly changing the potential difference of the supply voltage value $V_{35}$ and the development voltage $V_{34}$. The image density $D_I$ is likely to change largely when changing the development voltage $V_{34}$ than the supply voltage value $V_{35}$. Therefore, before the development voltage $V_{34}$ after the correction is applied, the supply voltage value $V_{35}$ after the correction is applied. With this, the image density $D_I$ can be slightly reduced from a state in which the image density $D_I$ is increased by the continuous print operation while keeping the development voltage $V_{34}$ constant.

Figure 14:
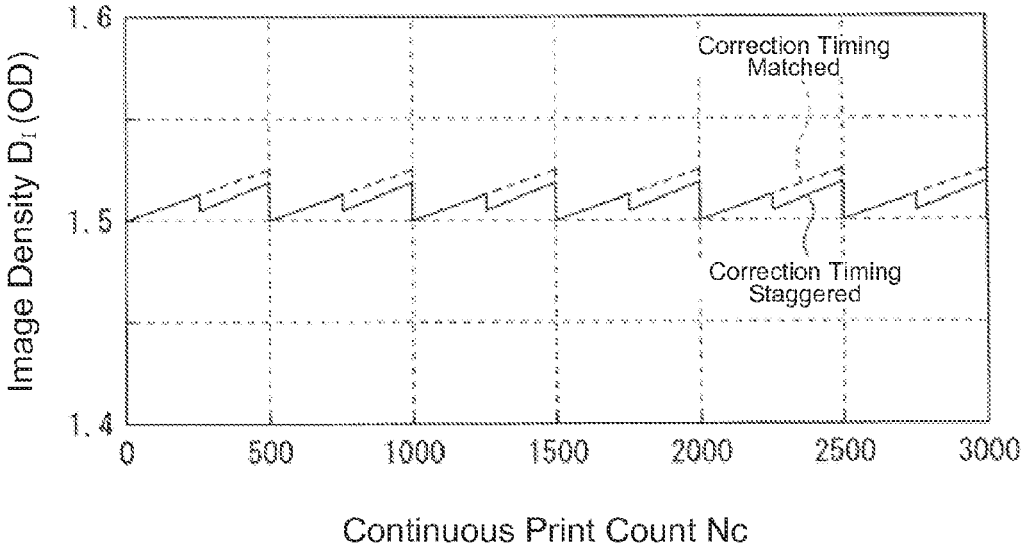
FIG. 14 is a diagram showing one example of the changes in the image density between when the correction timings were matched and when they were staggered.

FIG. 14 shows an example of the change in the image density $D_I$ when the correction timings for the development voltage $V_{34}$ and the supply voltage value $V_{35}$ are matched and when they were staggered. In FIG. 14, the dashed line indicates the image density $D_I$ when the correction timings for the development voltage $V_{34}$ and the supply voltage value $V_{35}$ are matched, and the solid line indicates the image density $D_I$ when the correction timing of the development voltage $V_{34}$ and the supply voltage value $V_{35}$ is staggered. From FIG. 14, it can be understood that the difference of the image density $D_I$ at the time of correction is smaller when the correction timing for the development voltage $V_{34}$ and the supply voltage value $V_{35}$ is staggered in comparison to when the correction timing of the development voltage $V_{34}$ and the supply voltage value $V_{35}$ is matched.

Modified Example 3

In the aforementioned embodiment and the modified examples, the width of the plurality of ranges Ac1 can be different for each range Ac2. In the aforementioned embodiment and the modified examples, for example, the width of the plurality of ranges Ac1 can become narrower as the range Ac2 is low. Further, hereinafter, although the development voltage $V_{34}$ is exemplified, similar things can be said about the supply voltage $V_{35}$.

Figure 15:
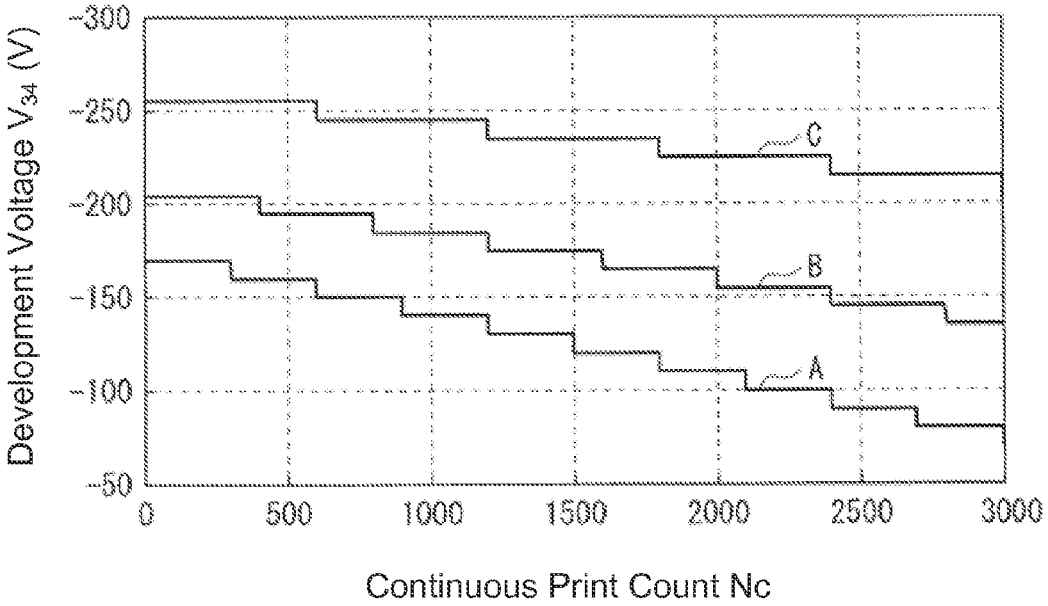
FIG. 15 is a diagram showing one example of the changes in the development voltage.

FIG. 15 shows an example of the change in the development voltage $V_{34}$ in the image forming units of the three lines (dashed line A, solid line B, dotted line C) as shown in FIG. 4. In FIG. 15, the width of each range Ac1 (interval for executing the voltage correction) is the narrowest for the dashed line A in which the increase of the image density DI is relatively large during continuous printing, and the widest for the dashed line A in which the increase of the image density $D_I$ is relatively small during continuous printing.

In FIG. 15, the correction value (potential difference) in the dashed line A, the solid line B, and the dotted line C is +10 volts. For the dashed line A in which the setting value $V_{34S}$ of the development voltage $V_{34}$ at the start of the continuous printing is the lowest, the width of each of the ranges Ac1 (interval for executing the voltage correction) is 300 counts. For the solid line B, the width of each range Ac1 (interval for executing the voltage correction) is 400 counts. For the dotted line C, the width of each range Ac1 (interval for executing the voltage correction) is 600 counts. Therefore, the number of correction in a continuous print count Nc is different for the dashed line A, the solid line B, and the dotted line C. For example, when the continuous print count Nc is 2,000 counts, for the dashed line A, the correction number is six times and the correction voltage value is +60 volts, and the development voltage $V_{34}$ is −110 volts. For example, when the continuous print count Nc is 2,000 counts, for the dotted line C, the correction number is three times, the correction voltage value is +30 volts, and the development voltage V34 is −225 volts.

Figure 16:
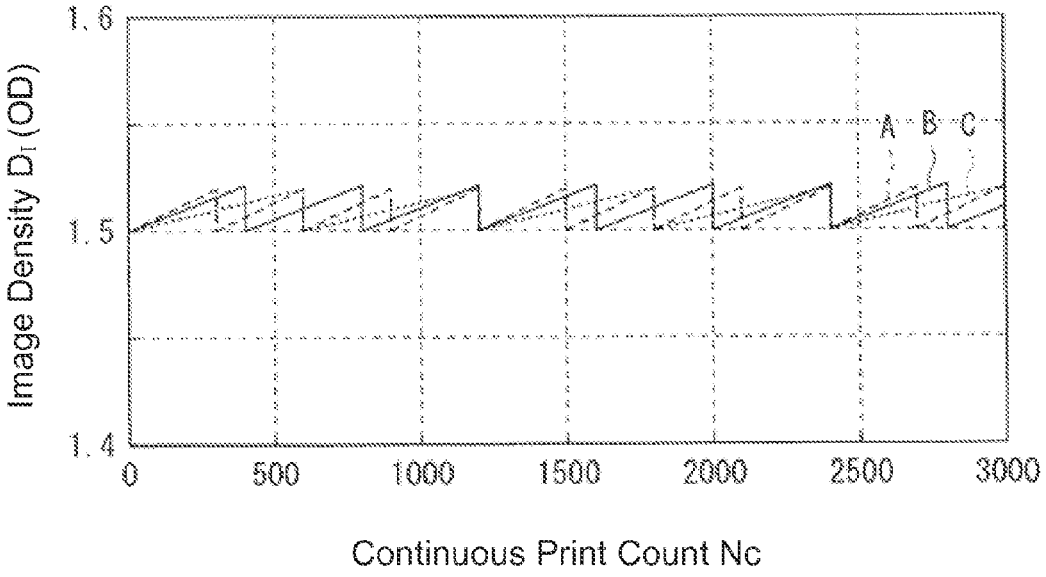
FIG. 16 is a diagram showing one example of the changes in the image density.

FIG. 16 shows an example of the change in the image density $D_I$ in the image forming units of the three lines (dashed line A, solid line B, dotted line C) as shown in FIG. 4 when the correction as shown in FIG. 15 is performed. In FIG. 16, for the dashed line A, it can be understood that, by making the width of each of the ranges Ac1 (interval for executing the voltage correction) narrower than the dotted line C, the fluctuations of the image density $D_I$ in the dashed line A can be suppressed.

Modified Example 4

In the aforementioned embodiment and the modified example, in the correction table 130, the correction value of the development voltage $V_{34}$ is assigned for each range Ac2, but it can be a constant value regardless of the size of the development voltage $V_{34}$ set by the voltage setting part 114. That is, in the correction table 130, the setting range of the development voltage $V_{34}$ does not need to be divided. In such a case, since the amount of data of the correction table 130 becomes smaller in comparison to the aforementioned embodiment, the capacity of the nonvolatile memory 106 can be made small.

Modified Example 5

Hereinafter, various modified examples will be explained.

In the aforementioned embodiment, the development method was a method using a non-magnetic single-component developer. However, in the aforementioned embodiment and the modified examples, the developing method can be a two component magnetic brush development method including a magnetic carrier and a non-magnetic toner, or a single component magnetic development method using a magnetic toner. Further, in the aforementioned embodiment, the image transfer was an indirect system. However, in the aforementioned embodiment and the modified examples, the image transfer can be a direct system. Further, in the aforementioned embodiment and the modified example, four colors of image forming units 30Y, 30M, 30C, and 30K were used. However, in the aforementioned embodiment and the modified example, for example, three or less colors or five or more colors of image forming units can be used. In the aforementioned embodiment, LED heads 33 were used. However, in the aforementioned embodiment and the modified examples, a laser element, etc., can be used instead of the LED head 33 or with the LED head 33. Further in the aforementioned embodiment, the medium P was constituted as a roll sheet wound in a rolled shape. However, the medium P can be a cut paper. In that case, the medium container part 10 is equipped with a sheet feeding tray for accommodating a plurality of mediums P instead of the holding shaft 11.

In the aforementioned embodiment and the modified example, the aforementioned density correction was not performed unless the accumulation count Nt exceeded the threshold Nc_th. However, in the aforementioned embodiment and the modified example, when the printing is finished, the control part 101 can perform the aforementioned density correction even when the accumulation count Nt does not exceed the Nc_th but meets the predetermined conditions. The control part 101 can perform the aforementioned density correction when, for example, the printing is finished in a state in which the accumulation count Nt exceeds Nc_th/2. In such a case, the image density can be homogenized.

The series of processes explained in the aforementioned embodiment and the modified example can be performed by hardware (circuit) or software (program). When the aforementioned series of processes are performed by software, the software is constituted by a program group for executing each function by a computer. Each program can be, for example, integrated into the aforementioned computer in advance or used by being installed onto the aforementioned computer from a network or a recording medium.

In the aforementioned embodiment and the modified example, an embodiment of the present invention was explained by exemplifying a color electrographic printer. However, the present invention is not limited to the application to a color machine or a printer, and is capable of being applied to image forming apparatuses in general for forming images onto a carried medium. The present invention can be applied for, for example, monochromatic copy machine, a color copy machine, a monochromatic MFP, a color MFP, etc.

In the aforementioned embodiment and the modified example, an image forming apparatus having printing functions was explained as an example of the "image forming apparatus" of the present invention. However, the present invention is not limited to an application for an image forming apparatus having printing functions, and for example, is capable of being applied to an image forming apparatus that functions as a multifunctional machine having scanning functions and fax functions.

What is claimed is:

1. An image forming apparatus, comprising:

an image carrier that has a peripheral surface including a photosensitive body;

a charge member that charges the peripheral surface;

an exposure part that forms an electrostatic latent image on a charge region on the peripheral surface charged by the charge member;

a developer carrier that develops the electrostatic latent image by a developer into two types of development images which are printing developer image and no-printing developer image, the printing developer image being to be printed on a medium, and the no-printing developer image being not to be printed but formed on the image carrier before the printing developer image is printed to the medium;

a supply member that supplies the developer to the developer carrier;

a first detection part that detects a first physical quantity correlating to the density of the no-printing developer image;

a setting part that performs a setting, based on the first physical quantity detected by the first detection part, for at least one of a development voltage to be applied to the developer carrier and a supply voltage to be applied to the supply member;

a second detection part that detects a second physical quantity correlating to a number of rotations of the image carrier after the print of the printing developer image starts;

a correction part that corrects, based on the second physical quantity detected by the second detection part, at least one of the development voltage and the supply voltage set by the setting part; and a power source part that applies the development voltage to the developer carrier and applies the supply voltage to the supply member, and with the corrections performed by the correction part, the corrected development voltage to be applied to the developer carrier is generate, and the corrected supply voltage to be applied to the supply member is generated.

2. The image forming apparatus according to claim 1, further comprising a control part that controls the power source part so as to change the development voltage before the correction to the corrected development voltage during continuous printing without stopping the printing when the correction is made to the development voltage by the correction part, and controls the power source part so as to change the supply voltage before the correction to the corrected supply voltage during continuous printing without stopping the printing when the correction is made to the supply voltage by the correction part.

3. The image forming apparatus according to claim 2, wherein the power source applies a most updated development voltage to the developer carrier and a most updated supply voltage to the supply member until the next correction is performed by the correction part.

4. The image forming apparatus according to claim 2, wherein the power source part makes a timing to apply the corrected development voltage to the developer carrier different from a timing to apply the corrected supply voltage to the supply member when both the development voltage and the supply voltage are corrected by the correction part.

5. The image forming apparatus according to claim 4, wherein the power source part applies the corrected development voltage to the developer carrier after applying the corrected supply voltage to the supply member when both the development voltage and the supply voltage are corrected by the correction part.

6. The image forming apparatus according to claim 2, wherein the power source part applies the corrected development voltage to the developer carrier at the same time as applying the corrected supply voltage to the supply member when both the development voltage and the supply voltage are corrected by the correction part.

7. The image forming apparatus according to claim 2, wherein the memory part further stores a correction table, in the correction table, a detection range of the second physical quantity is divided into a plurality of first ranges by a plurality of the first thresholds, and the correction value of at least one of the development voltage and the supply voltage is assigned to each of the divided first range, and the correction part fetches the correction value assigned to one of the first ranges from the memory part, the first ranges to which the second physical quantity detected by the second detection part belong, and performs the correction using the fetched correction value.

8. The image forming apparatus according to claim 7, wherein in the correction table, at least one of the setting ranges of the development voltage and the supply voltage is divided into a plurality of second ranges and the correction value is assigned for each of the divided second ranges, and the correction part fetches the correction value assigned to the second range to which at least one of the development voltage and the supply voltage set by the setting part belongs from the memory part and performs the correction using the fetched correction value.

9. The image forming apparatus according to claim 8, wherein, in each of the first ranges of the correction table, the correction value is different for each of the second ranges.

10. The image forming apparatus according to claim 9, wherein, in each of the first ranges of the correction table, an absolute value of the correction value increases as the second range becomes lower.

11. The image forming apparatus according to claim 8, wherein a width of a plurality of the first ranges is different for each of the second ranges.

12. The image forming apparatus according to claim 11, wherein a width of a plurality of the first ranges is narrower as the second range becomes lower.

13. The image forming apparatus according to claim 1, further comprising a memory part that stores a plurality of first thresholds that are different from each other; wherein the correction part performs the correction every time when the second physical quantity detected by the second detection part exceeds one of the first thresholds, and the power source part applies the corrected development voltage to the developer carrier during the continuous printing when the correction is made to the development voltage by the correction part, and the power source part applies the corrected supply voltage to the supply member during the continuous printing when the correction is made to the supply voltage by the correction part.

14. The image forming apparatus according to claim 13, wherein the control part stops printing every time when the second physical quantity detected by the second detection part exceeds the second threshold, the correction part initializes the second physical quantity to an initial value every time when the printing is stopped, the first detecting part performs the detection while the printing is stopped;

the setting part performs the setting every time when the detection is performed, the control part starts printing after the setting is performed, and every time when the development voltage is reset by the setting part, the power source part applies a reset development voltage to the developer carrier and every time when the supply voltage is reset by the setting part, the power source part applies a reset supply voltage to the supply member.

* * * * *